US011426994B2

(12) United States Patent
Röder et al.

(10) Patent No.: US 11,426,994 B2
(45) Date of Patent: Aug. 30, 2022

(54) DEVICE AND METHOD FOR THE DECORATION OF OBJECTS

(71) Applicant: ISIMAT GmbH Siebdruckmaschinen, Ellwangen (DE)

(72) Inventors: Wolfgang Röder, Remshalden (DE); Bernd Egetemeir, Ellenberg (DE)

(73) Assignee: ISIMAT GmbH Siebdruckmaschinen, Ellwangen (DE)

( * ) Notice: Subject to any disclaimer, the term of this patent is extended or adjusted under 35 U.S.C. 154(b) by 0 days.

(21) Appl. No.: 16/617,217

(22) PCT Filed: May 24, 2018

(86) PCT No.: PCT/EP2018/063659
§ 371 (c)(1),
(2) Date: Nov. 26, 2019

(87) PCT Pub. No.: WO2018/219778
PCT Pub. Date: Dec. 6, 2018

(65) Prior Publication Data

US 2020/0198366 A1 Jun. 25, 2020

(30) Foreign Application Priority Data

Jun. 2, 2017 (DE) ..... 102017112259.1

(51) Int. Cl.
*B41F 16/00* (2006.01)
*B41J 3/407* (2006.01)
(Continued)

(52) U.S. Cl.
CPC ..... *B41F 16/0033* (2013.01); *B41J 3/4073* (2013.01); *B41J 3/40733* (2020.08);
(Continued)

(58) Field of Classification Search
CPC ..... B05D 1/286; B05D 3/067; B05D 5/06; B65C 3/08; B44C 1/1733; B41M 5/03;
(Continued)

(56) References Cited

U.S. PATENT DOCUMENTS 4,664,670 A * 5/1987 Mehl ..... G03G 9/0926 524/211
6,001,427 A * 12/1999 Breazeale ..... F02F 7/006 427/466
(Continued)

FOREIGN PATENT DOCUMENTS

CN 104210232 A 12/2014
DE 202004019382 U1 2/2005
(Continued)

OTHER PUBLICATIONS

English translation of DE102005029640.*
(Continued)

*Primary Examiner* — Sonya M Sengupta
(74) *Attorney, Agent, or Firm* — Hoffmann & Baron LLP

(57) ABSTRACT

A device and a method for the decoration of objects to be decorated, wherein the object is held by a holding device. In a first step decorative material is applied to a transfer medium by a printing device. In a second step adhesive is applied to the transfer medium provided with the decorative material or to the object, and in a third step the transfer medium is pressed onto the object by a pressing device and at the same time the adhesive is cured by a curing device.

44 Claims, 7 Drawing Sheets

(51) Int. Cl.

| | |
|---|---|
| ***B41F 19/06*** | (2006.01) |
| ***B41F 19/00*** | (2006.01) |
| ***B41J 2/01*** | (2006.01) |
| ***B41M 5/03*** | (2006.01) |
| ***B44C 1/17*** | (2006.01) |

(52) U.S. Cl.
CPC ..... *B41F 16/0006* (2013.01); *B41F 16/008* (2013.01); *B41F 16/0086* (2013.01); *B41F 19/004* (2013.01); *B41F 19/007* (2013.01); *B41F 19/062* (2013.01); *B41J 2002/012* (2013.01); *B41M 5/03* (2013.01); *B44C 1/1733* (2013.01)

(58) Field of Classification Search
CPC ..... B41J 2002/012; B41J 3/4073; B41J 3/40733; B41F 16/0006; B41F 16/0033; B41F 16/008; B41F 16/0086; B41F 19/004; B41F 19/007; B41F 19/062
See application file for complete search history.

(56) References Cited

U.S. PATENT DOCUMENTS

| | | | | |
|---|---|---|---|---|
| 6,151,130 | A * | 11/2000 | Liguori | B44C 1/1733 358/1.12 |
| 2002/0097280 | A1* | 7/2002 | Loper | B41J 3/40731 347/2 |
| 2002/0175986 | A1 | 11/2002 | Miyamoto | |
| 2003/0165753 | A1 | 9/2003 | Suzuki et al. | |
| 2008/0106568 | A1 | 5/2008 | Albrecht et al. | |
| 2008/0111877 | A1 | 5/2008 | Heyse et al. | |
| 2009/0139649 | A1* | 6/2009 | Albrecht | B41F 16/0033 156/387 |
| 2011/0284156 | A1* | 11/2011 | Prenzel | C08F 287/00 156/60 |
| 2013/0160405 | A1* | 6/2013 | Preckel | B05D 3/06 427/532 |
| 2014/0354744 | A1 | 12/2014 | Ohnishi | |
| 2015/0251409 | A1 | 9/2015 | Ohnishi | |
| 2015/0343761 | A1* | 12/2015 | Roeder | B41F 16/008 156/215 |
| 2016/0136969 | A1* | 5/2016 | Allen | B44F 9/10 30/32 |
| 2017/0182704 | A1* | 6/2017 | Allen | B41J 3/40733 |
| 2017/0182705 | A1* | 6/2017 | Allen | B29C 66/474 |
| 2017/0182756 | A1* | 6/2017 | Cassoni | B41J 3/40733 |
| 2018/0072045 | A1 | 3/2018 | Kosalla et al. | |
| 2018/0311997 | A1* | 11/2018 | Triepel | B42D 25/328 |
| 2020/0198366 | A1* | 6/2020 | Röder | B05D 5/06 |

FOREIGN PATENT DOCUMENTS

| | | | | |
|---|---|---|---|---|
| DE | 102005029640 | A1 | 12/2006 | |
| DE | 102012112556 | A1 | 6/2014 | |
| DE | 102015118841 | A1 | 5/2017 | |
| EP | 2065217 | A1 | 6/2009 | |
| JP | 2012061743 | A | 3/2012 | |
| JP | 2013132640 | A | 7/2013 | |
| JP | 2013166587 | A | 8/2013 | |
| JP | 2018520903 | A | 8/2018 | |
| NL | 7809041 | A * | 3/1980 | B44C 1/1733 |
| RU | 2100209 | C1 | 12/1997 | |
| WO | 03/020519 | A1 | 3/2003 | |
| WO | 03020519 | A1 | 3/2003 | |
| WO | 2014050777 | A1 | 4/2014 | |

OTHER PUBLICATIONS

English translation of DE102012112556.*
English translation of DE202004019382.*
English translation of abstract of JP2013237262.*
English translation of abstract of JP2014029468.*
English translation of claims of JP2013237262.*
English translation of claims of JP2014029468.*
English translation of description of JP2014029468.*
International Search Report dated Aug. 17, 2018.
Examination Report from the German Patent Application dated Mar. 15, 2018.

* cited by examiner

DEVICE AND METHOD FOR THE DECORATION OF OBJECTS

This application claims priority based on an International Application filed under the Patent Cooperation Treaty, PCT/EP2018/063659, filed on May 24, 2018, and German Application No. 102017112259.1, filed on Jun. 2, 2017.

TECHNICAL FIELD

The present invention relates to a device and a method for the decoration of objects to be decorated, in particular three-dimensional objects, preferably objects with cylindrical, oval or angular cross section, in particular tubes, bottles, glasses, flacons and containers made of glass, ceramic, plastic or metal, as well as substantially two-dimensional objects, such as tracks, strips, arcs, plates, disks, panels, or boards.

STATE OF THE ART

The hot-stamping method is known for the decoration of paper, labels and plastic and glass packaging with decorative films, in particular with metallized films. In that process, a transfer or stamping film is coated with a hot-melt adhesive. By a transfer or stamping film is preferably meant a decorative material arranged detachably on a plastic carrier film, in particular a metal layer and/or, an ink layer. In a hot-stamping machine, the adhesive layer is activated with a stamping die using pressure and temperature, with the result that an adhesion forms between decorative material and printed article. The plastic carrier film is then peeled off.

In addition, there is the so-called cold-stamping method, in which a transfer or stamping film is likewise used. In this process, however, an adhesive is first deposited on an article in a first device using a printing method (offset printing, flexographic printing, inkjet printing or screen printing). The transfer film provided with a decorative material, in particular with a metal layer, coming from an unrolling device, is laminated onto the article and the adhesive layer is dried. The metal layer can be implemented as a vapor-deposited metallized layer and/or as a printed metal pigment layer. The decorative material thereby adheres to the locations previously printed with adhesive and the plastic carrier film with the residual, not adhering, decorative material is peeled off and disposed of. An adhesive that cures under UV light (UV adhesive) is often used as adhesive. The drying of the adhesive is effected in particular by means of UV light through the film.

The cold-stamping method has a range of advantages over the hot-stamping method. For one thing, there is no need to heat the adhesive using a stamping die. As no stamping die is necessary, the tool costs incurred are low. Furthermore, a cold-stamping device can be integrated into a printing machine, with the result that there is no need for a separate production process.

However, cold stamping onto three-dimensional objects such as for example onto glasses, bottles or tubes is not possible with the known methods. In the known methods, after the lamination, the material to be provided with the metallization as decorative material and the transfer film must be guided in parallel for a while in order to be able to achieve a drying of the adhesive. Three-dimensional objects are, however, pushed for example onto a holding device, such as for example a holding mandrel described in the German utility model DE 202004019382 U1, and rotated about the longitudinal axis by this during the printing at various work stations. The object is thereby accessible from all sides and it is possible to print all round the object.

From DE 102012112556 A1 a method and a device for cold stamping are known, wherein in a first step at a first work station an adhesive is applied to an object and in a second step at a second work station a transfer film provided with a metal layer unrolled from a roll by means of a transport device is pressed onto the object by a pressing device and at the same time the adhesive is cured. A disadvantage is that the production of the transfer film used here is effected in a separate production process. Widely different layers are applied, as decorative material, successively to the carrier film of the transfer film, in particular are printed and/or vapor-deposited. The thus-completed transfer film then has to be transported to the device in which the objects are decorated and attached or damped therein. Thus, for one thing, there is outlay on transport and, for another, the type of decoration is dependent on what layers of decorative material are provided in what arrangement on the transfer film. The plastic carrier film additionally has to be disposed of after one use.

As described above, in the known devices and methods the transfer film is rolled up after production thereof, in order to be able to transport it to the device having the pressing device. When it is being rolled up, the decorative material printed onto the transfer film necessarily comes into contact with the back of the transfer film of the next or preceding winding—depending on which way round the transfer film is rolled up. Due to this contact, adhesions to the back of the transfer film can occur if the decorative material is not yet completely dried, which can in turn lead to flaking during the later unrolling and therefore to defective representations on the objects to be printed.

DESCRIPTION OF THE INVENTION

Starting from the known state of the art, an object of the present invention is to provide an improved device for the decoration of objects to be decorated, as well as a corresponding method.

The object is achieved by a device for the decoration of objects to be decorated with the features of claim 1 as well as by, a method for the decoration of objects with the features of claim 27. Advantageous developments of the device and of the method result from the dependent claims as well as the present description and the figures.

Correspondingly, a device for the decoration of objects to be decorated is proposed, having a holding device for holding an object and a pressing device for pressing a transfer medium provided with decorative material onto the object. According to the invention a printing device for applying the decorative material to the transfer medium is provided in front of the pressing device. The printing device is preferably designed to print a multi-colored decorative material on the transfer medium. Correspondingly, a method for the decoration of objects to be decorated is further proposed, wherein an object to be decorated is held by a holding device. In a first step decorative material is applied to a transfer medium by a printing device, in a second step adhesive is applied to the transfer medium provided with the decorative material or to the object, and in a third step the transfer medium is pressed onto the object by a pressing device and, in particular at the same time, the adhesive is cured by a curing device.

Because a printing device for applying the decorative material to the transfer medium is provided in front of the pressing device, the decorative material can be printed on the transfer medium in the same device shortly or substantially immediately before the pressing and transferring, therefore the decoration of the object to be decorated, is effected. As a result, any changes of the decoration or the design of the print and/or the quantity of objects to be decorated can be responded to quickly and flexibly. A separate printing on whole film webs and an additionally necessary unrolling before the printing and a subsequent rolling up after the printing are not necessary. The logistical outlay in order to print on the objects and the waste of transfer material are thus reduced. In addition, a system having the device can be constructed smaller and simpler than systems known from the state of the art, as the separate device for producing the transfer film as well as any devices for transporting the rolled-up ready-made transfer film are dispensed with. The method according to the invention also requires a less complex structure, as the method steps of the separate production and the subsequent rolling up of the ready-made transfer film necessary in methods from the state of the art in a separate device as well as the transporting of the rolled-up printed transfer film to a further device are dispensed with.

In addition, it is thereby now only ever the transfer medium that is to be printed on, a direct printing on the object to be decorated is no longer necessary. Thus, objects with a complex or strongly curved shape can also be printed on in a simple manner. Furthermore, the conditions during the printing or stamping are substantially always the same. This is because it is always the transfer medium that is printed on, therefore always on a surface remaining the same in particular with respect to its physical and chemical nature, for which the parameters of the printing process can be exactly and optimally set. In this respect, the outlay on process engineering for decorating the objects is low.

By "in front of the pressing device" is meant here that the printing device is arranged upstream of the pressing device viewed in a movement direction of the pressing device or a movement direction of the transfer medium. In other words, a section of the transfer medium first passes through the printing device and then reaches the pressing device.

Consequently, a printing of decorative material on the transfer medium at least in sections is effected first by the printing device and then, preferably immediately thereafter, a transfer of the decorative material to the object is effected by the pressing device. The application of adhesive to the printed transfer medium and/or to the object is preferably effected after decorative material is printed on the transfer medium and yet before the decorative material is transferred to the object.

Accordingly, the transfer medium need not be rolled up after being printed on with decorative material, but can be directly guided further to the pressing device without previously coming into contact with a surface, in particular the back of the rolled-up transfer medium.

By a transfer medium is meant in particular a flexible carrier material, in particular a flexible plastic carrier film, to which the decorative material can be applied detachably again. The transfer medium can be for example a plastic carrier film made of polyester, polyolefin, polyvinyl, polyimide, acrylonitrile-butadiene-styrene copolymers (ABS), polyethylene terephthalate (PET), polycarbonates (PC), polypropylene (PP), polyethylene (PE), polyvinyl chloride (PVC) or polystyrene (PS), in particular with a layer thickness of from 5 μm to 50 μm, preferably of from 7 μm to 23 μm, advantageously with a primer layer applied thereto. Thus, it is possible for the transfer medium to comprise a primer layer.

By a primer layer is preferably meant here an adhesion-promoter layer, through which the subsequent layers adhere better to the plastic carrier film.

The primer layer preferably consists of polyacrylates and/or vinyl acetate copolymers with a layer thickness of from 0.1 μm to 1.5 μm, preferably of from 0.5 μm to 0.8 μm, which forms in particular a surface of the transfer medium facing away from the carrier material. The primer layer can be optimized with respect to the adhesive used in terms of its physical and chemical properties, with the result that an optimum adhesion between object and transfer medium is guaranteed as far as possible irrespective of the object. Furthermore, a primer layer optimized in such a way makes it possible for the applied adhesive to remain on the transfer medium in the desired resolution largely without running, spreading or squeezing.

In particular, it is expedient if the primer layer is microporous and preferably has a surface roughness in the range of from 100 nm to 180 nm, further preferably in the range of from 120 nm to 160 nm. The adhesive can penetrate partially into such a layer and is thereby particularly well fixed in high resolution.

It has proved to be particularly favorable for a primer layer with a pigment count of from 1.5 $cm^3/g$ to 120 $cm^3/g$, preferably with a pigment count of from 10 $cm^3/g$ to 20 $cm^3/g$, to be used.

By way of example, for the calculation, the composition of a primer layer is indicated below (data in grams):

| | |
|---|---|
| 4900 | organic solvent ethyl alcohol |
| 150 | organic solvent toluene |
| 2400 | organic solvent acetone |
| 600 | organic solvent benzine 80/110 |
| 150 | water |
| 120 | binder I: ethyl methacrylate polymer |
| 250 | binder II: vinyl acetate homopolymer |
| 500 | binder III: vinyl acetate vinyl laurate copolymer, SC = 50 +/− 1% |
| 400 | binder IV: isobutyl methacrylate |
| 20 | pigment multifunctional silicon oxide, average particle size 3 μm |
| 5 | filler micronized amide wax, particle size 3 μm to 8 μm |

The following is true for the pigment count for this primer layer:

$$PC = \sum_{1}^{x} \frac{(m_P \times f)_x}{(m_B + m_A)} = \frac{20\ \text{g} \times 750}{1020\ \text{g} + 0\ \text{g}} = 14.7\ \text{cm}^3/\text{g}$$

where:

mp=20 g multifunctional silicon oxide f=ON/d=300/0.4 $g/cm^3$=750 $cm^3/g$ for multifunctional silicon oxide $m_B$=120 g binder I+250 g binder II+(0.5×500 g) binder III+400 g binder IV=1020 g $m_A$=0 g.

In this way, starting from a composition of the primer layer found to be good, further possible pigmentations deviating therefrom can be calculated quickly and in an uncomplicated manner.

Furthermore, it is expedient if the primer layer has a surface tension of from 38 mN/m to 46 mN/m, preferably of from 41 mN/m to 43 mN/m. Such surface tensions allow adhesive droplets, in particular of adhesive systems such as described above, with defined geometry to adhere to the surface without running.

If a thermoplastic toner is used, it has proved to be particularly favorable for a primer layer with a pigment count of from 0.5 $cm^3/g$ to 120 $cm^3/g$, preferably with a pigment count of from 1 $cm^3/g$ to 10 $cm^3/g$, to be used.

By way of example, for the calculation, the composition of a primer layer for this use is indicated below (data in grams):

| | |
|---|---|
| 340 | organic solvent ethyl alcohol |
| 3700 | organic solvent toluene |
| 1500 | organic solvent acetone |
| 225 | binder I: chlorinated polypropylene |
| 125 | binder II: poly-n-butyl-methyl-methacrylate |
| 35 | binder III: n-butyl-methyl-methyl-methacrylate copolymer |
| 148 | pigment multifunctional silicon oxide, average particle size 12 nm |

The following is true for the pigment count for this primer layer:

$$PC = \sum_{1}^{x} \frac{(m_P \times f)_x}{(m_B + m_A)} = \frac{148\ \text{g} \times 4.4}{385\ \text{g} + 0\ \text{g}} = 1.69\ \text{cm}^3/\text{g}$$

where:

mp=148 g multifunctional silicon oxide f=ON/d=220/50 $g/cm^3$=4.4 $cm^3/g$, for multifunctional silicon oxide $m_B$=225 g binder I+125 g binder II+35 g binder III=385 g $m_A$=0 g.

The decorative material is preferably applied directly to the transfer medium. However, it is also possible for the decorative material to be applied to an already existing coating of the transfer medium. It is likewise possible for the transfer medium to be provided with an existing coating only on areas of the surface and for the decorative material to be applied in free areas between the existing coating and/or to the existing coating. The existing coating can be for example a detachment layer or another functional layer. The existing coating can alternatively or additionally also be for example an already existing decorative coating made of printed and/or vapor-deposited ink layers, metal layers, reflective layers, protective layers, functional layers or the like.

The detachment layer preferably consists of an acrylate copolymer, in particular of an aqueous polyurethane copolymer, and is preferably free of wax and/or free of silicone. The detachment layer preferably has a layer thickness of from 0.01 μm to 2 μm, preferably of from 0.1 μm to 0.5 μm, and is advantageously arranged on a surface of the plastic carrier film. The detachment layer makes a simple and damage-free detachment of the plastic carrier film from the transfer medium possible after the application thereof to the object.

The decorative material preferably has one or more varnish layers made of nitrocellulose, polyacrylate and polyurethane copolymer with a layer thickness in each case of from 0.1 μm to 5 μm, preferably of from 1 μm to 2 μm, which is arranged in particular on a surface of the detachment layer facing away from the plastic carrier film. The one or more varnish layers can in each case be transparent, translucent or opaque. Thus, it is possible for the one or more varnish layers to be transparently dyed, translucently dyed or opaquely dyed.

The dyeing of the one or more varnish layers can be based on the process colors cyan, yellow, magenta and black, but also on spot colors (e.g. in the RAL or HKS or Pantone® color system). The one or more varnish layers can alternatively or additionally contain metal pigments and/or in particular optically variable effect pigments.

The one or more varnish layers can be present over the whole surface or also only partially, for example as so-called spot varnishing. Optical effects in areas of the surface are made possible by spot varnishing. In that process, areas are varnished in a targeted manner for example with a gloss varnish and/or with a matte varnish, in order to optically alter the respective area of surface, in particular to enhance it. As an alternative or in addition to the optical effect, haptic effects can thereby also be achieved. The decorative material preferably has a metal layer made of aluminum and/or chromium and/or silver and/or gold and/or copper, in particular with a layer thickness of from 10 nm to 200 nm, preferably of from 10 nm to 50 nm.

As an alternative or in addition to the metal layer, a layer made of an HRI material (HRI=High Refractive Index) can also be provided. HRI materials are for example metal oxides such as ZnS, $TiO_x$ or also varnishes with corresponding nanoparticles.

The printing device is preferably set up to print on the transfer medium using screen printing, flexographic printing, digital printing (e.g. inkjet printing, xerographic printing, liquid toner printing) or offset printing.

In the case where a decorative material curable by means of UV radiation is printed on the transfer medium, it is advantageous to precure the decorative material using a UV light source directly after being printed onto the transfer medium. Thus, it makes sense if the printing device has a UV light source for precuring the decorative material, which is preferably arranged at the end of the printing device and/or in front of an adhesive-applying device. In particular, the viscosity of the decorative material is increased hereby. This prevents the applied areas of the decorative material from running or from squeezing too much during the further processing, with the result that a particularly sharp-edged application of the decorative material and a particularly high surface quality of the transferred layers on the object can be achieved. A slight squeezing of the decorative material is actually desirable in order to bring directly neighboring areas of the decorative material, in particular tiniest areas, so-called pixels, closer to each other and to combine them. This can be advantageous in order to prevent a pixelation of the representation for example in the case of closed surface areas and/or at motif edges, i.e. to prevent individual pixels from appearing optically in a disruptive manner. The squeezing preferably may be effected only so far that the desired resolution is not too strongly reduced. Advantageously, the UV light is emitted in the wavelength range of from 220 nm to 420 nm, preferably in the wavelength range 350 nm to 400 nm.

The UV light source for precuring the decorative material is preferably an LED light source. With LED light sources, virtually monochromatic light can be provided, with the result that it is ensured that the required radiation intensity is available in the wavelength range necessary for curing the adhesive. As a rule, this cannot be achieved with conventional medium-pressure mercury-vapor lamps.

In a preferred embodiment the device furthermore has an adhesive-applying device for applying adhesive to the transfer medium provided with decorative material and/or to the object and a curing device for curing the adhesive, wherein the curing, device is preferably arranged in the area of the pressing device and the pressing device is set up such that the pressing of the transfer medium and the curing of the adhesive can be effected at the same time. The decorative material of the transfer medium thereby adheres to the locations on the object provided with adhesive. If, after that, the transfer medium is removed from the object after the pressing, the decorative material remains on the object at the desired locations. At the locations at which no adhesive has been applied to the object or the transfer medium, the decorative material does not adhere to the object, but remains on the carrier material of the transfer medium.

The adhesive-applying device is preferably set up to deposit the adhesive by means of screen printing, flexographic printing, digital printing (e.g. inkjet printing, xerographic printing, liquid toner printing).

In a further preferred embodiment the adhesive-applying device is arranged between the printing device and the pressing device, wherein the adhesive-applying device applies the adhesive in particular to the transfer medium printed on by the printing device, in particular to a surface of the transfer medium facing away from the carrier material. Among other things, it can thereby be prevented that during the later pressing of the transfer medium onto the object there is an offset or too great a tolerance between the decorative material and alternatively adhesive previously applied to the object and the decorative material is incorrectly transferred to the object.

Alternatively or additionally, the adhesive can be transferred to the object with the adhesive-applying device in an upstream station.

A particularly advantageous, compact and simple structure of the device can be achieved if the adhesive-applying device is formed as part of the printing device. In the process, the adhesive-applying device is preferably arranged at the end of the printing device. In other words, the depositing of adhesive is effected after the transfer medium has been provided with the decorative material.

In the case where the adhesive has components curable by means of UV radiation, it is advantageous to precure the adhesive directly after the depositing of the adhesive on the transfer medium, in particular for a so-called "pinning" of the adhesive. Thus, it makes sense if the adhesive-applying device has a UV light source for precuring the adhesive, which is preferably arranged at the end of the adhesive-applying device and/or in front of the pressing device. In particular, the viscosity of the adhesive is increased hereby. This prevents the applied areas of the adhesive from running or from squeezing too much during the further processing, with the result that a particularly sharp-edged application of the decorative material and a particularly high surface quality of the transferred layers on the object can be achieved. A slight squeezing of the adhesive is actually desirable in order to bring directly neighboring areas of the printed medium, in particular tiniest areas, so-called pixels, closer to each other and to combine them. This can be advantageous in order to prevent a pixelation of the representation for example in the case of closed surface areas and/or at motif edges, i.e. to prevent individual pixels from appearing optically in a disruptive manner. The squeezing preferably may be effected only so far that the desired resolution is not too strongly reduced. Advantageously, the UV light is emitted in the wavelength range of from 220 nm to 420 nm, preferably in the wavelength range 350 nm to 400 nm.

The UV light source for precuring the adhesive is preferably an LED light source. With LED light sources, virtually monochromatic light can be provided, with the result that it is ensured that the required radiation intensity is available in the wavelength range necessary for curing the adhesive. As a rule, this cannot be achieved with conventional medium-pressure mercury-vapor lamps.

In order to ensure that the decorative material adheres to the transfer medium, in a further preferred embodiment a drying unit can be provided for drying the decorative material applied to the transfer medium, wherein the drying unit is preferably formed as part of the printing device. In particular when the adhesive is deposited on the printed transfer medium, it can thus be ensured that dried decorative material does not run or is not smeared during application of the adhesive to the transfer medium.

The drying unit can preferably be formed in such a way that a drying and/or curing by means of UV light radiation and/or a thermal drying is effected for a chemical or physical drying and/or curing.

The drying unit is upstream of the adhesive-applying device, with the result that first a drying of the decorative material applied to the transfer medium and then an application of the adhesive to the transfer medium, therefore to the decorative material printed onto the transfer medium, are effected.

In a preferred embodiment the device has a transfer media guide, which is set up to guide the transfer medium tangentially relative to the outer circumference of the object. The pressing device is arranged such that it presses the transfer medium onto the object along the area of contact between object and transfer medium. By rotation of the object through 360° about the axis of rotation the decorative material can thus be applied to the object at all locations.

The pressing device can preferably be moved such that the surface area speed of the pressing device can be matched to the surface speed of the object, and moreover the transfer medium can preferably be movable such that the surface area speed of the transfer medium can be matched to the surface speed of the object. In other words, the movement of the pressing device and the movement of the object can be synchronized with each other such that the movement of transfer medium and object relative to each other is as small as possible or preferably zero. It is hereby ensured that the pressing device, the transfer medium and object do not rub against each other. A smearing of the adhesive on the object is thereby prevented. Likewise, the danger of damage to the transfer medium or the object is reduced.

Thus, it is advantageous if the relative movement of transfer medium and object is set in such a way that a maximum unrolling tolerance of ±5 mm, preferably of ±3 mm, results and/or a maximum speed tolerance at the circumference of the object of ±15%, preferably of ±10%, results. Thus, it is possible for the surface area speed of the transfer medium and the surface speed of the object to differ by less than ±15%, preferably by less than ±10%.

In a further preferred design of the device the pressing device has a cylinder rotatable about the longitudinal axis of the cylinder. A pressing of the transfer medium onto the object can then be effected in that the transfer medium is guided, with simultaneous rotation of the cylinder about the longitudinal axis of the cylinder and of the object about the axis of rotation, between cylinder and object, or in that the transfer medium is unrolled by means of the cylinder over a preferably flat or smooth surface of the object.

As an alternative and/or in addition to the cylinder, the pressing device can also have a plate. The transfer medium can in this case be guided along directly against the plate and thereby be pressed against the object.

A particularly secure application of the decorative material to the object can be achieved if the adhesive is a UV-curing adhesive and the curing device has a UV light source for curing the adhesive, wherein the pressing device is transparent for UV light at least partially in partial areas and is arranged at least partially between UV light source and holding device.

The UV light is preferably emitted in the wavelength range of from 220 nm to 420 nm, further preferably in the wavelength range 350 nm to 400 nm.

It is thus possible for the device for the decoration of objects to have several UV light sources. Thus, it is possible for the device for the decoration of objects to have a first UV light source for precuring the decorative material, which is preferably arranged at the end of the printing device and/or in front of an adhesive-applying device, a second UV light source for precuring the adhesive, which is preferably arranged at the end of the adhesive-applying device and/or in front of the pressing device, and/or a third UV light source for curing the adhesive, which is preferably encompassed by the curing device, wherein the curing device is preferably arranged in the area of the pressing device and the pressing device is set up such that the pressing of the transfer medium and the curing of the adhesive can be effected at the same time.

The pressing device is in particular transparent or translucent for UV radiation in the wavelength range of from 220 nm to 420 nm, preferably in the range of from 350 nm to 400 nm, particularly preferably in the range of from 365 nm to 395 nm. The transparency or translucence is in particular, to be 30% to 100%, preferably 40% to 100%. A lower transparency or translucence can be compensated for by higher UV intensity.

For example LED emitters, mercury-vapor lamps, or also iron- and/or gallium-doped mercury-vapor lamps can be used as UV light sources.

The UV light source for curing the adhesive is preferably an LED light source. With LED light sources, virtually monochromatic light can be provided, with the result that it is ensured that the required radiation intensity is available in the wavelength range necessary for curing the adhesive. As a rule, this cannot be achieved with conventional medium-pressure mercury-vapor lamps.

The distance from the UV light source for curing the adhesive to the object is advantageously 2 mm to 50 mm, preferably 2 mm to 40 mm, in order to achieve an optimum full cure, but at the same time in particular to prevent physical contact of the UV light source with the object. The size of the irradiation window of the UV light source for curing the adhesive in the machine direction is preferably between 5 mm and 40 mm.

If LED light sources are used, the energy of the radiation usually decreases comparatively strongly from approx. 5 mm distance from the LED light source, in particular because of the relatively high divergence of the LED light source, with the result that the distance from the object is preferably to be chosen correspondingly small. Through the use of LED light sources with optical focusing, a greater distance from the object is made possible, whereby in particular use in constructively difficult conditions is also made possible. It is further possible for the irradiation window if LED light sources with optical focusing are used to be smaller, in particular in comparison with an irradiation window if UV light sources without optical focusing are used.

The gross UV irradiance is preferably between 1 W/cm$^2$ and 50 W/cm$^2$, preferably between 3 W/cm$^2$ and 40 W/cm$^2$. It is hereby achieved that the adhesive is completely full-cured with web speeds of from approximately 10 m/min to 60 m/min (or higher) and optionally the other factors already discussed with reference to the precuring.

If these factors are heeded, the adhesive is irradiated in this method with a net UV irradiance of preferably between 4.8 W/cm$^2$ and 8.0 W/cm$^2$. This corresponds to a net energy input (dose) with a preferred irradiation time between approximately 0.1 s (with 10 m/min web speed and an irradiation window 20 mm wide) and approximately 0.04 s (with 30 m/min web speed and an irradiation window 20 mm wide) into the adhesive of from approximately 100 mJ/cm$^2$ to 2000 mJ/cm$^2$, preferably of from approximately 100 mJ/cm$^2$ to 1000 mJ/cm$^2$, in particular wherein this net energy input is variable depending on the full cure required.

It is to be borne in mind here in particular that these values are only theoretically possible (at 100% lamp power). In particular at full power of the UV light source for curing the adhesive, e.g. with a 20 W/cm$^2$ version, and a low web speed, e.g. 10 m/min, the transfer medium heats up so strongly that it can catch fire. The net energy input therefore particularly preferably lies between 100 mJ/cm$^2$ and 500 mJ/cm$^2$ depending on the web speed.

For example, the UV light source can be arranged inside a cylinder of the pressing device. For this, the cylinder is designed at least in some locations as a hollow cylinder. The material of the cylinder is chosen such that the wavelengths of the UV light which are required for the curing of the adhesive can be transmitted through the cylinder. The cylinder can be completely transparent for the UV light; however, transparent windows can also be provided in the cylinder, with the result that UV light only exits the cylinder precisely when the UV light is required for the curing of the adhesive.

In the areas transparent for UV light, the cylinder can consist for example of PMMA (polymethyl methacrylate, acrylic glass) and/or of borosilicate glass. Both materials have, in particular in the wavelength range of from 350 nm to 400 nm, a transmittance of at least 50%, preferably of at least 70%.

The transmittance is in particular the proportion of incident electromagnetic waves, in this case "light", which penetrates a component. Depending on the property layer structure or layer thickness, the transmittance can be different. The transmittance is thus a measure of the intensity allowed through, i.e. transmitted, and assumes values between 0 and 100%.

As has been described in the preceding section, it is possible for the cylinder of the pressing device to be completely or partially transparent, with the result that the UV light can be transmitted sufficiently, in particular in order to completely cure or full-cure the adhesive. Preferably, the decorative material here also has a sufficient transmittance, in particular in order to be able to cure the adhesive on the back of the printed image by means of UV light. Here, in practical tests, it has been shown that in particular in the case of a multicolored printed image a transmittance of the decorative material of at least 2.5% in the wavelength range between 350 nm and 400 nm of the UV light is sufficient in order to be able to achieve a sufficient exposure of the adhesive located behind it in the exposure direction.

In measurements of the transmittance of the decorative material the following values were determined, for example:

| Color shade of the decorative material | Transmittance in percent at approximately 395 nm | Layer thickness of the decorative material in μm |
|---|---|---|
| Glazing color varnish, cyan | 35% | 6 |
| Glazing color varnish, magenta | 53% | 6 |
| Glazing color varnish, yellow | 15% | 6 |
| Glazing color varnish, black | 3.5% | 6 |
| Covering color varnish, white | 0% | 15 |
| Vapor-deposited aluminum with a thickness of from approx. 15 nm to 20 nm | 6.3% | — |

If in particular the transmittance of the decorative material is too low for a sufficient exposure of the adhesive, for example in the case of the opaquely white decorative material mentioned above, it is advantageous that the decorative material is arranged in the form of a grid in first zones with decorative material and second zones without decorative material. It is particularly advantageous here to arrange the first and/or second zones in the form of thin lines and/or small grid elements with a line width and/or with a minimum grid element dimension of less than 500 μm, preferably of less than 250 μm. The UV light can reach through the second zones without decorative material to the adhesive in a sufficient quantity and there expose these sufficiently for the curing. The first zones can be at least partially irradiated from below because of their small size, with the result that the adhesive can also be at least partially exposed, and thus cured, there.

The ratio of the average width of the first zones to the average width of the second zones is preferably between 0.75:1 and 1:5. Thus, the width of the first zones is preferably less than 250 μm and the width of the second zones is more than 250 μm.

The first and second zones are preferably arranged according to a one- or two-dimensional grid, for example a line grid or a surface grid. Thus, it is possible for the first zones and/or second zones to be formed as dots or in the shape of a polygon. The grid element shapes are preferably selected from: dots, diamonds and crosses. However, it is also possible to use differently formed grid element shapes.

The grid or the distribution of the first and second zones is preferably formed regular or random (stochastic) or pseudo-random.

It is further also possible for the one- or two-dimensional grid to be a geometrically transformed grid. Thus, it is possible for example for it to be a circularly or wavily transformed one-dimensional grid, wherein for example the first zones are provided in the form of concentric circular rings or in the form of wavy lines.

The area of the object which is to be illuminated with UV light can preferably be set such that the curing of the UV adhesive is advanced during the pressing of the transfer medium onto the adhesive until the decorative layer of the transfer medium adheres to the object and can be released from the transfer medium. Depending on the adhesive used and the intensity of the UV light, for this purpose it can be necessary to illuminate the adhesive on the object already in front of the line of contact between object and transfer medium. The setting of the area to be illuminated can be effected for example by (optionally settable or replaceable) diaphragms between UV light source and object. One or more diaphragms can also be attached directly to the pressing device. The setting can also be effected, by setting to the divergence of the UV light emitted by the UV light source.

In a further preferred embodiment of the method the adhesive-applying device is a flexographic printing station. The adhesive can then be applied to the object by means of a printing plate attached to the printing block cylinder. Alternatively, the adhesive-applying device can also be a screen-printing station or a digital-printing station (for example an inkjet-printing station, xerographic-printing station, liquid-toner printing station).

In a further preferred embodiment of the device the pressing device furthermore has a flexible pressing layer. Irregularities of the object, the transfer medium and/or the machine structure can be compensated for hereby. The flexible pressing layer can consist for example of silicone.

In a further preferred embodiment of the method the pressing layer is transparent for UV light at least in partial areas. The areas in which the pressing layer is transparent can be geared to the areas in which the pressing device is transparent. However, the pressing layer can also be completely transparent, while the pressing device is transparent only in areas.

In a particularly preferred further embodiment the transfer medium is provided as an endless belt. It is thereby possible to use the transfer medium multiple times. In other words, the transfer medium need not be rolled up and disposed of after the printing by the printing device and the transfer of the decorative material to an object in the pressing device, but can be diverted and fed to the printing device again. The transfer medium is preferably formed as a transparent, dimensionally stable, in particular tension-stable, endless belt. In this embodiment, in particular the decorative material is completely transferred from the transfer medium to the object, with the result that the transfer medium then has as little decorative material as possible and can be used again.

In order to achieve radiation emitted from the curing device being able to penetrate through the transfer medium in sufficient strength, it can be formed transparent for the respective wavelength ranges and/or have a coating for separation during the transfer of the decorative material to the object, in particular a detachment layer. A secure transfer of the decorative material and a secure curing of the adhesive are thereby achieved.

In a preferred development the transfer medium provided as an endless belt is clamped between a transfer media guide and the pressing device. It can thereby be ensured that the transfer medium is always aligned correctly. At the same time, the transfer medium can be driven in its movement direction by the friction achieved between transfer media guide and transfer medium by means of the clamping. The transfer medium provided as an endless belt is preferably clamped between a preferably motor-driven cylinder of the pressing device and a preferably motor-driven tensioning roller of the transfer media guide.

In a further preferred embodiment the transfer medium is arranged directly on the pressing device, preferably on a cylinder of the pressing device. A particularly simple structure of the device can be achieved hereby.

In a further preferred embodiment the device furthermore has a cleaning device for cleaning the printed transfer medium after the printing of the transfer medium onto the object. Adhesive residues and the parts of the decorative material which were not transferred by the pressing device from the transfer medium to the object can thereby be removed from the transfer medium. The thus-cleaned transfer medium can thereby be re-used.

In a further preferred embodiment the device furthermore has a pretreatment device for pretreating the transfer medium before the application of the decorative material. The surface of the transfer medium to be printed on can hereby be improved with respect to the adhesion behavior of the decorative material on the transfer medium. In addition, a secure adhesion of the decorative material during the printing of the transfer medium and a secure detachment of the decorative material from the transfer medium during the transfer of the decorative material to the object can thus be made possible.

In order to achieve a particularly efficient and secure printing and transfer of, the decorative material, the transfer medium can be provided with a coating for better separation during the transfer of the decorative material to the object, in particular a detachment layer, by the pretreatment device. Furthermore, irregularities in the surface of the transfer medium can be compensated for by the pretreatment device.

In a preferred embodiment the surface of the object is pretreated before the decoration. This pretreatment can comprise in particular an object-cleaning step and/or an activation step.

In the object-cleaning step dirt and/or also existing protective coatings or other functional coatings which were applied in particular for the transport of the object and/or during the production of the object are preferably removed.

In the case of glassy surfaces in, particular problems continue to occur because of the moisture bound to the surface. The moisture is here bound in particular in the form of gel layers, which negatively affect the adhesive properties of the layers subsequently to be is applied to the surface.

The ability of the surface to make an adhesion to layers subsequently to be applied, in particular a decoration, possible also depends on the applied or produced reactive groups on the surface, as these are the basis for the fixed binding of the subsequently applied layers. The density in particular of the reactive OH groups located in the silicate layer of glass is not sufficient in the known methods, which leads to a reduced adhesion of the layers applied afterwards.

In the activation step, which is preferably effected after the object-cleaning step, the surface of the object is advantageously modified in such a way that an adhesion of the subsequently applied decoration is increased and improved. The modification can be effected chemically and/or physically.

The object-cleaning step comprises in particular a modification of the surface of the object with at least one oxidizing flame. The object-cleaning step has the advantage that the moisture bound to the amorphous surface of the compact substrate in the form of inhomogeneous gel layers is reduced. Surprisingly, the gel layer is reproducibly reduced by the object-cleaning step. The gel layer is dependent on the respective amorphous structure as well as on the ageing state of the gel layer. The gel layer and thus the bound moisture are reduced by the oxidizing flame. The reduction of the gel layer leads to reproducible, homogeneous surface properties.

By an oxidizing flame is meant here any ignited gas, gas-air mixture, aerosol or spray which contains an excess of oxygen and/or can have an oxidizing action.

The activation step comprises in particular modifying the surface of the object with at least one silicating flame. In the process a silicon oxide layer up to 60 nm, preferably 5 nm to 50 nm, further preferably 10 nm to 30 nm, thick which is characterized by a high content of reactive OH groups is applied. The homogeneity and the good adhesive properties of the deposited silicon oxide layer are achieved by the combination of the object-cleaning step and the activation step. It is advantageous to choose the number of flames such that one to ten, in particular one to five, oxidizing and/or silicating flames modify the surface of the object.

The reactive groups on the surface are the chemical basis for a fixed chemical bonding of the subsequently applied surface-treating layers, for example wax layers and/or varnish layers and/or ink layers. If the surface consists of an amorphous substance, for example of glass, the area density of the OH groups of the surface of the compact substrate according to the invention is 2 to 5 times higher than in the case of untreated surfaces.

The silicon oxide layer or silicate layer applied in the second treatment step has a submicroscopic roughness. The roughness and the associated mechanical anchoring possibility for further layers lead to a clearly improved adhesion of all subsequent layers. A reproducible, homogeneous, microretentive surface is produced through the object-cleaning step and the activation step. The combination of the two method steps surprisingly leads to a reduction of the gel layer and to an increase in the density and to a homogeneous distribution of the reactive OH groups.

In the activation step, for the flame treatment, a gas is used which contains compounds having components selected from the group alkyl silanes, alkoxy silanes, alkyl titanium, alkoxy titanium, alkyl aluminum, alkoxy aluminum or combinations thereof.

Preferred examples of such compounds are tetramethyl silane, tetramethyl titanium, tetramethyl aluminum, tetraethyl silane, tetraethyl titanium, tetraethyl aluminum, 1,2-dichlorotetramethyl silane, 1,2-dichlorotetramethyl titanium, 1,2-dichlorotetramethyl aluminum, 1,2-diphenyltetramethyl silane, 1,2-diphenyltetramethyl titanium, 1,2-diphenyltetramethyl aluminum, 1,2-dichlorotetraethyl silane, 1,2-dichlorotetraethyl titanium, 1,2-dichlorotetraethyl aluminum, 1,2-diphenyltetraethyl silane, 1,2-diphenyltetraethyl titanium, 1,2-diphenyltetraethyl aluminum, 1,2,3-trichlorotetramethyl silane, 1,2,3-trichlorotetramethyl titanium, 1,2,3-trichlorotetramethyl aluminum, 1,2,3-triphenyltetramethyl silane, 1,2,3-triphenyltetramethyl titanium, 1,2,3-triphenyltetraethyl aluminum, dimethyldiethyl tetrasilane, dimethyldiethyl tetratitanium, dimethyldiethyl tetraaluminum and similar compounds.

In addition, among such alkyl compounds, a silane compound, an alkyl titanium compound and an alkyl aluminum compound, tetramethyl silane, tetramethyl titanium, tetramethyl aluminum, tetraethyl silane, tetraethyl titanium and tetraethyl aluminum are preferred modifying compounds because of their particularly low boiling point and their easy miscibility with air and similar gases, while a silane halide compound such as 1,2-dichlorotetramethyl silane is preferably used as modifier.

In addition, alkoxy silane, alkoxy titanium and alkoxy aluminum compounds are to be preferred among the above-named compounds, as long as their boiling point lies in the range between 10° C. and 100° C., as generally, although they usually have high boiling points because of their ester structure, they make an even better surface-modifying action of the solid substrate possible.

By a silicating flame within the meaning of the invention is meant any ignited gas, gas-air mixture, aerosol or spray with the aid of which a silicon oxide layer is applied to a surface by flame pyrolytic decomposition of a silicon-containing substance. It can in particular be provided that the silicon-containing coating is applied substantially carbon-free and that in the flame pyrolysis a silicon alkoxy silane is introduced as silicon-containing substance into a mixture of air and combustion gas as well as oxygen as needed. The combustion gas comprises for example propane gas, butane gas, coal gas and/or natural gas.

It is advantageous if the value of the average molecular weight of the modifying compound lies in the range of from 50 to 1000, preferably in the range of from 60 to 500, further preferably in the range of from 70 to 200, measured by mass spectrum analysis. With an average molecular weight of the modifying compound below 50 the volatility is high and the handling is sometimes difficult. If, on the other hand, the value of the average molecular weight of the modifying compound lies above 1000, the vaporization by heating and slight mixing with air or similar gases is difficult in some cases.

Further, it is advantageous if the density of the modifying compound in the liquid state lies in the range of from 0.3 $g/cm^3$ to 0.9 $g/cm^3$, preferably in the range of from 0.4 $g/cm^3$ to 0.8 $g/cm^3$, further preferably in the range of from 0.5 $g/cm^3$ to 0.7 $g/cm^3$. With a density value of the modifying substance in the liquid state below 0.3 $g/cm^3$ the handling is made more difficult and the accommodation in aerosol cans sometimes becomes problematic. If, on the other hand, the density of the modifying compound in the liquid state lies above 0.9 $g/cm^3$, the vaporization is made more difficult and in the case of accommodation in aerosol cans a complete separation can result in some cases with air or similar gases.

It is advantageous if the modifying compound is heated and vaporized, and is mixed with the combustion gas in the vaporized state and then combusted. The boiling point of the modifying compound preferably lies between 10° C. and 80° C.

The quantity of the modifying compound in the combustion gas has in particular a value in the range of from $1\times10^{-10}$ mol-% to 10 mol-% of the total quantity of the combustion gas.

The wetting index after the surface modification has in particular a value in the range of from 40 mN/m (dyn/cm) to 80 mN/m (dyn/cm) at a measurement temperature of 25° C.

The flame temperature of the oxidizing and/or silicating flame preferably lies in the range of from 500° C. to 1500° C., in particular of from 900° C. to 1200° C., and/or the surface of the object is advantageously heated to 35° C. to 150° C., in particular to 50° C. to 100° C.

The duration of treatment with the oxidizing and/or silicating flame lies in particular in the range of from 0.1 seconds to 100 seconds, preferably in the range of from 0.1 seconds to 10 seconds, particularly preferably in the range of from 0.1 seconds to 5 seconds.

In order to be able to easily control the flame temperature of the oxidizing and/or silicating flame, it is recommended to add a combustible gas to the combustion gas. Hydrocarbon gases such as propane gas and natural gas or combustible gases such as hydrogen, oxygen, air and the like can be used as such combustible gases. If combustible gases which are stored in aerosol cans are used, is to be preferred to use propane gas and compressed air or the like.

It is preferred that the value of the quantity of combustible gas contained lies in the range of from 80 mol-% to 99.9 mol-% of the total quantity of combustion gas, preferably in the range of from 85 mol-% to 99 mol-%, further preferably in the range of from 90 mol-% to 99 mol-%. With a combustion gas content below 80 mol-% the mixing properties of the modifying compound decrease and the air leads in some cases to an incomplete combustion of the modifying compound. If the value of the combustion gas quantity contained, on the other hand, lies above 99.9 mol-%, in some cases the modifying action of surfaces does not apply.

It is preferred to also add a carrier gas for the oxidizing and/or silicating flame, in order to be able to mix the quantity of the modifying compound uniformly into the combustion gas. It is to be preferred to premix the modifying compound with a carrier gas and then to mix it into the combustible gas, such as e.g. the air stream. Through the addition of a carrier gas, even if a modifying compound with a relatively high molecular weight which is to be transported only with difficulty is used, this can be mixed uniformly into the air stream. Through the addition of the carrier gas the modifying compound becomes easily combustible and the modification of the surface of the article can be carried out uniformly and sufficiently.

It is preferred that the same gas type as for the combustible gas, e.g. air and oxygen or hydrocarbon gases such as propane gas and natural gas, is used for the carrier gas.

Through the combined treatment of the surface with at least one oxidizing and at least one silicating flame, a homogeneous, microretentive surface is provided which has a high density of reactive groups.

The roughness and the good adhesive property of the silicate layer applied in the activation step advantageously have the result that a subsequently applied decoration, in particular the subsequently applied decorative material, for example a printing ink or other decorative or functional layers, adheres very well. The decorative material applied to the silicate layer are is advantageously scratch- and abrasion-resistant and has a high resistance to water and water vapor. Due to the homogeneous silicate layer produced, a high ink coverage of the printing inks applied by the decoration is advantageously achieved. The properties of the decorative layers such as hue, color strength, metamerism, coverage and transparency can advantageously be virtually freely chosen through the correspondingly pretreated surface.

The object-cleaning step and/or the activation step can in particular be carried out with the aid of a further pretreatment device for pretreating the object. The further pretreatment device for pretreating the object can be designed for the implementation of both steps or a separate object-cleaning device and a separate activation device can be provided separately from each other.

The further pretreatment device for pretreating the object and/or the object-cleaning device and/or the activation device can be designed as a module for installation in the device for the decoration of objects, in particular for installation in the holding device. With the corresponding module, a pretreatment of the surface of the object can then be carried out inside the device before subsequent process steps are carried out.

The pretreatment device and/or the object-cleaning device and/or the activation device can also be designed as a separate device which can correspondingly pretreat the surface of the object independently of further devices.

The object-cleaning device and/or the activation device can, in a preferred embodiment, have a ring-shaped flame treatment device, wherein the object to be pretreated is arranged inside a ring and the oxidizing or silicating flame can emerge from the ring in the direction of the surface of the object.

The object-cleaning device and/or the activation device can, in a further embodiment, have a flame treatment device formed rectilinear at least in sections. This flame treatment device is then guided or moved in sections over the surface to be pretreated of the object.

The object-cleaning device and/or the activation device can, in a further embodiment, have a flame treatment device with one or more flames emerging at points. This flame treatment device is then guided or moved in sections over the surface to be pretreated of the object. During the decoration of three-dimensional objects the object is held in the holding device preferably rotatable about an axis of rotation. This axis of rotation is preferably the longitudinal axis of the objects.

In a further embodiment the device has a transfer media unrolling device and/or a transfer media rolling-up device, preferably with a transfer media guide, for the transfer medium.

In the device or the method for the decoration of objects it is now possible to transport the transfer medium either continuously or pulsed, wherein the pressing of the transfer medium provided with the decorative material onto the object, i.e. in particular the object decoration, and/or the object transport is expediently effected in a pulsed manner.

There is thus a possibility that the transfer medium is transported continuously. Here, in particular a continuous web speed of the transfer medium is an optimum prerequisite for the continuous printing on the transfer medium by the printing device, for example by means of digital printing technology, in high quality.

Thus it is possible for the, in particular pulsed, application of the decorative material to the transfer medium to be effected in the printing device at the same time during the, in particular pulsed, pressing of the transfer medium provided with decorative material onto the object in the pressing device.

Preferably, a repeating pattern between the individual printing sections is determined depending on the pulse and/or print speeds. Thus it is possible for the repeating pattern between the individual printing sections to become larger or smaller depending, on the pulse and/or print speed. In particular, the repeating pattern is determined or calculated from the known pulse speed of the object transport and the object decoration. Preferably, in particular in the case of a continuous transport of the transfer medium, the pulsed printing on the transfer medium is effected at the same time during the pulsed object decoration. Advantageously, the repeating pattern is roughly half as "long" (length in relation to the transport speed of the transfer medium) as the object pulse (object decoration and object transport). The repeating pattern is preferably usually set to be constant over the entire course, and is not regulated.

A disadvantage of such a continuous process is that in particular the consumption of the transfer medium is very high, whereby the costs increase.

A further possibility is, that the transfer medium is driven in the, in particular same, pulse of the transport device of the object. In this case, the transfer medium is not continuously driven, but the transfer medium is driven or paused depending on the process section.

Thus, it is possible for the trans medium to be driven depending on the, in particular pulsed, pressing of the transfer medium provided with decorative material onto the object in the pressing device. Here, the driving of the transfer medium is preferably effected in the pulse of the transport device of the object. Thus, it is possible for the application of the decorative material to the transfer medium and the pressing of the transfer medium provided with decorative material onto the object to be effected in a pulsed manner, wherein the transfer medium is driven or paused depending on the pulsed pressing of the transfer medium.

Here, it is advantageous that the repeating pattern between the decorative material, in particular the printed images, and thus the consumption of the transfer medium is reduced. The printing is preferably effected in the same pulse as that of the object. During the printing process, however, the acceleration and the braking of the transfer medium is in particular also effected, with the result that the printing process very often takes place at varying speeds.

A disadvantage of such a pulsed process is that the quality of the applied decorative material, such as for example the print quality of the digital pint, is negatively affected in particular by the constantly changing web speed.

A further advantageous possibility is to combine the continuous process and the pulsed process. Here, on the one hand, a continuous web speed of the transfer medium during the printing process and, on the other hand, a pulsed web speed of the object during the object decoration, i.e. in particular during the transfer process, in which the pressing of the transfer medium provided with decorative material onto the object is expediently effected, are preferably sought.

Thus, it is possible for the pressing of the transfer medium provided with decorative material onto the object to be effected in a pulsed manner, wherein the application of the decorative material to the transfer medium is effected at a continuous web speed.

In order to be able to combine the two variants, the device preferably comprises a compensation module or a "store", in particular in order to be able to "collect" or store the transfer medium in the store during an idle phase in the pulsed process for the object, with the result that the continuous web speed of the transfer medium advantageous for the quality of the printing is not impaired. The compensation module is in particular formed as a mechanical store, which provides the required transfer medium at the required process speed depending on the process section. Such a compensation module can be for example a receiving space for a loop of the transfer medium, in particular with means for maintaining the web tension of the transfer medium.

Preferably, the compensation module or a mechanical store can store the transfer medium inside the compensation module by a lateral movement and release the transfer medium again by changing the movement direction. Here, the maximum distance of the lateral movement of the compensation module or of the mechanical store inside the compensation module is preferably greater, in particular greater by a factor of 2 on average, than the distance which is covered by the transfer medium at a continuous web speed in a predetermined time. The predetermined time here preferably corresponds to the idle phase in which the object is decorated, in particular by pressing of the decorative material In other words, the pulsed extraction speed for the transfer medium during the extraction is preferably higher than, for example 1.5 times as high as, the continuous speed of filling with the transfer medium, in order that the store does not overflow.

To compensate for dimensional variations of the objects to be decorated, according to a further preferred embodiment, the pressing device, preferably a cylinder of the pressing device, can be mounted floating or suspended. For example, a pressure-regulated pneumatic cylinder and/or a pressure-regulated hydraulic cylinder can be used, wherein the pressing force of the cylinder onto the object during the transfer of the decorative material is variably adjustable by altering the air pressure setting of the pneumatic cylinder or the fluid pressure setting of the hydraulic cylinder. The compensation of dimensional variations relative to the surface of the object can be effected with the elastic vertical lifting movement of the cylinder corresponding to the set pressing force. Alternatively, the vertical variable lifting movement and the control of the pressing force can be effected via compression springs with settable spring tension, instead of with compressed air and pneumatic cylinder or fluid pressure and hydraulic cylinder.

To decorate preferably three-dimensional objects, in a preferred development, the pressing of the transfer medium onto the object is effected in that the object is rotated about an axis of rotation, in that the transfer medium is guided tangentially relative to the outer circumference of the object and in that the pressing device presses the transfer medium onto the object along the area of contact between object and transfer medium, wherein the pressing device is preferably moved such that the surface area speed of the pressing device corresponds to the surface speed of the object, and wherein the transfer medium is preferably moved such that the surface speed of the transfer medium corresponds to the surface speed of the object.

In a further preferred embodiment the pressing of the transfer medium onto the object is effected in that the object is held in a fixed position and the transfer medium is unrolled over the surface of the object by means of the pressing device, wherein the pressing device presses the transfer medium onto the object along the area of contact between object and transfer medium, wherein the pressing device is preferably moved along the object.

In a particularly preferred further embodiment of the method the transfer medium is provided as an endless belt, wherein the above-named sequence of steps is carried out multiple times, wherein in each case a further object is provided with decorative material each time the above-named sequence of steps is carried out. Thus, the transfer medium can be printed on a plurality of objects without resulting in waste in the form of transfer material or transfer film material used once and to be disposed of In this embodiment, in particular the decorative material is completely transferred from the transfer medium to the object, with the result that the transfer medium then has as little decorative material as possible and can be used again.

In order to improve the surface of the transfer medium with respect to the adhesion behavior of the decorative material on the transfer medium and thus in order to enable a secure adhesion of the decorative material during printing on the transfer medium and a secure detachment of the decorative material from the transfer medium during transfer of the decorative material to the object, and in order to be able to compensate for irregularities in the surface of the transfer medium, in a further preferred embodiment the transfer medium is pretreated before the application of the decorative material. If, during the pretreatment, the transfer medium is provided with a coating for better separation during the transfer of the decorative material to the object, in particular a detachment layer, a particularly efficient and secure printing and transfer of the decorative material can furthermore be achieved.

If, corresponding to a further preferred embodiment, the transfer medium is cleaned after the pressing, adhesive residues and the parts of the decorative material which were not transferred to the object during the pressing of the transfer medium onto it can be removed from the transfer medium and the thus-cleaned transfer medium can thereby be re-used, A particularly advantageous design results if the transfer medium provided as an endless belt is cleaned after passing through, the pressing device and then pretreated before the transfer medium is fed back to the printing device for renewed application of decorative material.

A UV adhesive is preferably used as adhesive and wherein the curing of the adhesive is o effected by irradiation with UV light.

A transparent adhesive with the following composition is preferably used:

| | |
|---|---|
| 2-phenoxyethyl acrylate | 10%-60%, preferably 25%-50%; |
| 4-(1-oxo-2-propenyl)-morpholine | 5%-40%, preferably 10%-25%; |
| exo-1,7,7-trimethylbicyclo[2.2.1]-hept-2-yl acrylate | 10%-40%, preferably 20%-25%; |
| 2,4,6-trimethylbenzoyldiphenyl-phosphine oxide | 5%-35%, preferably 10%-25%; |
| dipropylene glycol diacrylate | 1%-20%, preferably 3%-10%; |
| urethane acrylate oligomer | 1%-20%, preferably 1%-10%. |

If physical or chemical curing adhesive is used, the drying of the adhesive can alternatively be effected by a thermal drying unit.

In a preferred development the UV light is produced by a UV light source, wherein the pressing device is transparent for UV light at least in partial areas and is arranged at least partially between UV light source and holding device.

The above-named devices and methods are particularly suitable for transferring decorative material if the objects to be decorated are objects made of plastic, glass or metal, in particular cosmetics packaging, metal containers, glass bottles, drinking glasses and other glass, metal and plastic packaging, in particular with cylindrical, oval or angular cross section, in particular tubes, bottles, glasses, flacons and containers made of glass, ceramic, plastic or metal, as well as substantially two-dimensional objects, such as tracks, strips, arcs, plates, disks, panels, or boards.

BRIEF DESCRIPTION OF THE FIGURES

Preferred further embodiments of the invention are explained in ore detail by the following description of the figures. There are shown in.

DETAILED DESCRIPTION OF PREFERRED EMBODIMENT EXAMPLES

Preferred embodiment examples are described below with reference to the figures. Identical, similar or identically acting elements in the different figures are provided with the same reference numbers, and a repeated description of these elements is sometimes dispensed with in order to avoid redundancies.

Figure 1:
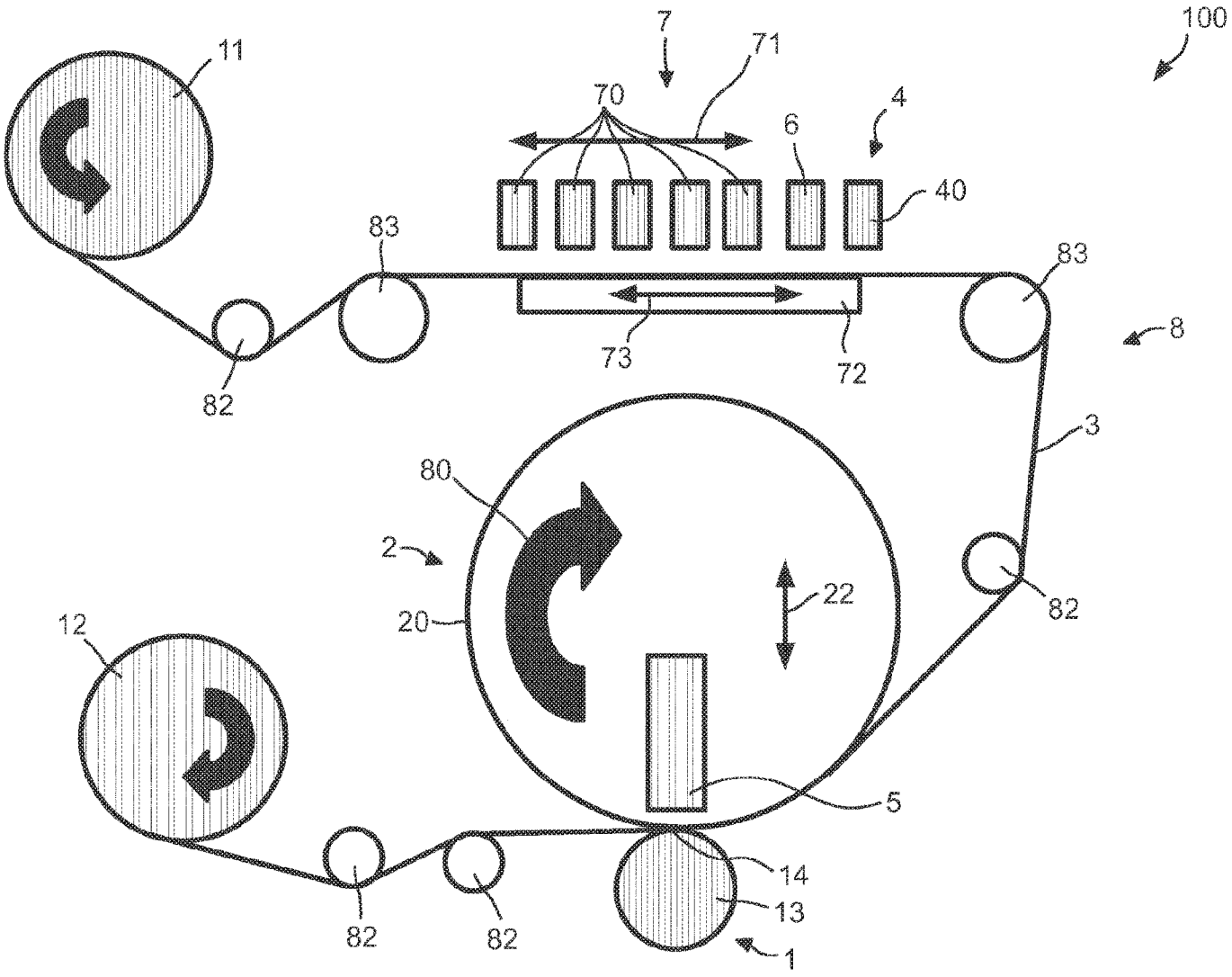
FIG. 1 a schematic representation of a device for be decoration of objects to be decorated.

A schematic representation of a device 100 for the decoration of objects 13 to be decorated is shown in FIG. 1. The device 100 has a transfer media unrolling device 11, from which a transfer medium 3 is unrolled. A printing device 7 for applying decorative material to the transfer medium 3 follows in the movement direction 80 of the transfer medium 3. After being printed on, by the printing device 7, the transfer medium 3 reaches a pressing device 2, which is placed opposite a holding device 1. Downstream of the pressing device 2 a transfer media rolling-up device 12 is arranged, on which the used transfer medium is rolled up again.

The device 100 furthermore has a transfer media guide 8, by means of which the transfer medium 3 is guided through the device 100 and by which the movement of the transfer medium 3 is predefined.

The holding device 1 can be for example a holding mandrel, onto which the three-dimensional object 13 is pushed. The object 13 is then held exclusively from the inside by friction of the holding mandrel with the inner surface of the object 13. Alternatively, the holding device 1 can also hold the object from the outside.

Coming from the transfer media unrolling device 11, the transfer medium 3 is fed via a settable deflection roller 82 to a vacuum roller 83. The transfer media guide and the transfer media tension are controlled via the deflection roller 82. A settable feed rate of the transfer medium 3 is predefined by means of the vacuum roller 83. A further vacuum roller 83 is arranged downstream in the movement direction 80. The rotational speed of this second vacuum roller 83 can be set a little higher than that of the first vacuum roller 83 to ensure a sufficient belt tension in the printing device 7. The intensity of the negative pressure of the vacuum rollers 83 can be set such that with the first vacuum roller 83 the transfer feed of the transfer medium 3 is predefined precisely with a greater negative pressure, and with a lower vacuum at the second vacuum roller 83 the tensioning force is regulated by friction of the transfer medium 3 against this vacuum roller 83. Corresponding to the different requirements for the decoration of different objects 13, the actuation of the vacuum rollers 83 can be effected with the reverse intensity, consequently the first vacuum roller 83 can be exposed to reduced negative pressure and the second vacuum roller 83 can be exposed to increased negative pressure. The vacuum rollers 83 can be equipped with multi-part vacuum sectors in order to actuate the respective areas of the vacuum rollers 83 in a targeted manner with separate vacuum setting of the sectors.

After the second vacuum roller 83, the transfer medium 3 is fed to the pressing device 2 via a further deflection roller 82, which is provided to compensate for a transfer media feed of the decoration printing unit 7 pulsed on the basis of the, printing process described in more detail further below in the printing device 7 and the thus varying transfer media tension, and from there is guided further via two further deflection rollers 83 for setting the transfer media tension to the transfer media rolling-up device 12 and is rolled up there.

The deflection roller 82 arranged between printing device 7 and pressing device 2 is arranged in such a way that it comes into contact with the transfer medium 3 on the back of the transfer medium 3, thus the unprinted side. Consequently, the transfer medium 3 min provided with the decorative material in the printing device 7 is fed to the pressing device 2, without the surface of the transfer medium 3 provided with the decorative material coming into contact with a surface beforehand.

The printing device 7 is formed as a digital printing device for printing on the transfer medium 3 by means of digital printing (for example inkjet printing, xerographic printing, liquid toner printing). Alternatively, the printing device 7 can also be formed as a screen printing, flexographic printing or offset printing device, wherein the printing can be effected monochromatic or multicolored.

The printing device 7 has a horizontally arranged printing base plate 72. The transfer medium 3 to be decorated is guided from the transfer media unrolling device 11 via the deflection roller 82 and the first vacuum roller 83 over the printing base plate 72 to the second vacuum roller 83. Above the printing base plate 72, the printing device 7 has a plurality of printheads 70, wherein a first printhead 70 is provided for printing a varnish layer as separation varnish or as detachment layer and as application aid for the transfer of the decorative material. This is followed by four further printheads 70 for the process colors cyan, yellow, magenta and black, in order to color-print on the transfer medium 3. The transfer medium 3 resting on or fixed to the printing base plate 72 is printed on by moving the printheads 70 over the printing base plate 72 at a predefined printhead speed along a printhead movement direction 71.

Alternatively, instead of the first or second vacuum roller 83, one or more further deflection rollers can be arranged. Furthermore, other drive types can also be provided for moving the transfer medium 3.

A drying unit 6 moveable synchronously with the printheads 70 for drying the decorative material applied to the transfer medium 3 and an adhesive-applying device 4 for applying adhesive to the transfer medium 3 provided with decorative material are furthermore integrated in the printing device 7. After the printing on the transfer medium 3, the drying unit 6 dries and/or partially or pre- or full-cures the inks deposited by the upstream printheads 70. In the present case the drying unit 6 is formed as a UV-light dryer unit for partially drying or fully drying and/or partially curing or precuring or full-curing the decorative material applied to the transfer medium 3. Alternatively, other drying methods can also be used.

In particular if a decorative material curable by means of UV radiation is printed on the transfer medium, it is advantageous to precure the decorative material using a UV light source directly after printing on the transfer medium 3. For this, it makes sense if the printing device 7 has a UV light source for precuring the decorative material which is preferably arranged at the end of the printing device 7 and/or in front of the adhesive-applying device 4. In particular, the viscosity of the decorative material is increased hereby. This prevents the applied areas of the decorative material from running or from squeezing too much during the further processing, with the result that a particularly sharp-edged application of the decorative material and a particularly high surface quality of the transferred layers on the object can be achieved. A slight squeezing of the decorative material is actually desirable in order to bring directly neighboring areas of the decorative material, in particular tiniest areas, so-called pixels, closer to each other and to combine them. This can be advantageous in order to prevent a pixelation of the representation for example in the case of closed surface areas and/or at motif edges, i.e. to prevent individual pixels from appearing optically in a disruptive manner. The squeezing preferably may be effected only so far that the desired resolution is not too strongly reduced. Advantageously, the UV light is emitted in the wavelength range of from 220 nm to 420 nm, preferably in the wavelength range 350 nm to 400 nm.

The UV light source for precuring the decorative material is preferably an LED light source. With LED light sources, virtually monochromatic light can be provided, with the result that it is ensured that the required radiation intensity is available in the wavelength range necessary for curing the adhesive. As a rule, this cannot be achieved with conventional medium-pressure mercury-vapor lamps.

After the drying, by means of an adhesive printhead 40, the adhesive-applying device 4 prints adhesive onto the locations of the decorative material layer which are later to be transferred to the three-dimensional article 13 in the pressing device 2.

In particular in the case where the adhesive has components curable by means of UV radiation, it is advantageous to precure the adhesive directly after the depositing of the adhesive on the transfer medium, in particular for a so-called "pinning" of the adhesive. Thus, it makes sense if the adhesive-applying device has a UV light source for precuring the adhesive, which is preferably arranged at the end of the adhesive-applying device and/or in front of the pressing device. In particular, the viscosity of the adhesive is increased hereby. This prevents the applied areas of the adhesive from running or from squeezing too much during the further processing, with the result that a particularly sharp-edged application of the decorative material and a particularly high surface quality of the transferred layers on the object can be achieved. A slight squeezing of the adhesive is actually desirable in order to bring directly neighboring areas of the printed medium, in particular tiniest areas, so-called pixels, closer to each other and to combine them. This can be advantageous in order to prevent a pixelation of the representation for example in the case of closed surface areas and/or at motif edges, i.e. to prevent individual pixels from appearing optically in a disruptive manner. The squeezing preferably may be effected only so far that the desired resolution is not too strongly reduced. Advantageously, the UV light is emitted in the wavelength range of from 220 nm to 420 nm, preferably in the wavelength range 350 nm to 400 nm.

The UV light source for precuring the adhesive is preferably an LED light source. With LED light sources, virtually monochromatic light can be provided, with the result that it is ensured that the required radiation intensity is available in the wavelength range necessary for curing the adhesive. As a rule, this cannot be achieved with conventional medium-pressure mercury-vapor lamps.

Alternatively, the printheads 70 and the printing base plate 72 can be arranged in a fixed position. During the printing process, the transfer medium 3 coming from the transfer media unrolling device 11 is then guided through over the printing base plate 72 under the printheads 70 by means of the first vacuum roller 83 and the second vacuum roller 83. The feed rate of the transfer medium 3 is set corresponding to the printing capacity of the printheads 70.

Furthermore, it is possible for the printing base plate 72 to be arranged moveable along a plate movement direction 73, in order to support the printing process.

With the printing device 7, measurement points can be printed onto the transfer medium 3 outside the decorative area which is to be transferred to the object 13 in order to be able to detect the position of the decorative material on the transfer medium 3 by means of sensors or at least one camera.

Once the printing process is complete, the transfer medium 3 is further transported to the pressing device 2 for transfer of the decorative material to the object 13.

The pressing device 2 has a transparent, rotatable, hollow cylinder 20, which is provided with a flexible pressing layer made of an elastic, transparent material, preferably a silicone material, on the outside. Because the pressing layer is elastic, irregularities of the three-dimensional object 13, the transfer medium 3 and/or the machine structure can be compensated for. The cylinder and the pressing layer are transparent for UV light in the present case, therefore a transmission of UV light through the cylinder 20 and its pressing layer is made possible.

The adhesive in the present case is a UV adhesive that cures under UV light. A curing device 5 in the form of a UV light source for curing the adhesive is arranged inside the cylinder 20. The emitting area of the curing device 5 is directed at the area of contact 14 of transfer medium 3 and object 13. In order that the UV light emitted by the UV light source in the direction of the object 13 can exit the cylinder 20, both the cylinder 20 and the pressing layer are made of materials which are transparent for the UV light needed for the curing. The transfer medium 3 is likewise transparent for the UV light needed for the curing.

The UV light source for curing the adhesive preferably emits UV radiation in the wavelength range between 220 nm and 420 nm, preferably between 350 nm and 400 nm.

The pressing device 2 is in particular transparent or translucent for the UV radiation in the wavelength range of from 220 nm to 420 nm, preferably in the range of from 350 nm to 400 nm, particularly preferably in the range of from 365 nm to 395 nm. The transparency or translucence is in particular to be 30% to 100%, preferably 40% to 100%. A lower transparency or translucence can preferably be compensated for by higher UV intensity.

For example LED emitters, mercury-vapor lamps, or also iron- and/or gallium-doped mercury-vapor lamps can be used as UV light source. The UV light source for curing the adhesive is preferably an LED light source. With LED light sources, virtually monochromatic light can be provided, with the result that it is ensured that the required radiation intensity is available in the wavelength range necessary for curing the adhesive. As a rule, this cannot be achieved with conventional medium-pressure mercury-vapor lamps.

The distance from the UV light source for curing the adhesive to the object 13 is advantageously 2 mm to 50 mm, preferably 2 mm to 40 mm, in order to achieve an optimum full cure, but at the same time in particular to prevent physical contact of the UV light source with the object 13. The size of the irradiation window of the UV light source for ring the adhesive in the machine direction is preferably between 5 mm and 40 mm.

If LED light sources are used, the energy of the radiation usually decreases comparatively strongly from approx. 5 mm distance from the LED light source, in particular because of the relatively high divergence of the LED light source, with the result that the distance from the object 13 is preferably to be chosen correspondingly small. Through the use of LED light sources with optical focusing, a greater distance from the object 13 is made possible, whereby in particular use in constructively difficult conditions is also made possible. It is further possible for the irradiation window if LED light sources with optical focusing are used to be smaller, in particular in comparison with an irradiation window if UV light sources without optical focusing are used.

The gross UV irradiance is preferably between 1 $W/cm^2$ and 50 $W/cm^2$, preferably between 3 $W/cm^2$ and 40 $W/cm^2$. It is hereby achieved that the adhesive is completely full-cured at web speeds of from approximately 10 m/min to 60 m/min (or higher) and the other factors already discussed with reference to the precuring.

If these factors are heeded, the adhesive is irradiated in this method with a net UV irradiance of preferably between 4.8 $W/cm^2$ and 8.0 $W/cm^2$. This corresponds to a net energy input (dose) with a preferred irradiation time between approximately 0.1 s (with 10 m/min web speed and an irradiation window 20 mm wide) and approximately 0.04 s (with 30 m/min web speed and an irradiation window 20 mm wide) into the adhesive of from approximately 100 mJ/cm$^2$ to 2000 mJ/cm$^2$, preferably of from approximately 100 mJ/cm$^2$ to 1000 mJ/cm$^2$, in particular wherein this net energy input is variable depending on the full cure needed.

It is to be borne in mind here in particular that these values are only theoretically possible (at 100% lamp power). In particular at full power of the UV light source for curing the adhesive, e.g. with a 20-W/cm$^2$ version, and a low web speed, e.g. 10 m/min, the transfer medium heats up so strongly that it can catch fire. The net energy input therefore particularly preferably lies between 100 mJ/cm$^2$ and 500 mJ/cm$^2$ depending on the web speed.

In the areas transparent for UV light, the cylinder 20 can consist for example of PMMA (polymethyl methacrylate, acrylic glass) and/or of borosilicate glass. Both materials have, in particular in the wavelength range of from 350 nm to 400 nm, a transmittance of at least 50%, preferably of at least 70%.

Further, it is possible for the cylinder 20 of the pressing device 2 to be completely or partially transparent, with the result that the UV light can be transmitted sufficiently, in particular in order to completely cure or full-cure the adhesive. Preferably, the decorative material here also has a sufficient transmittance, in particular in order to be able to cure the adhesive on the back of the printed image by means of UV light. Here, in practical tests, it has been shown that in particular in the case of a multicolored printed image a transmittance of the decorative material of at least 2.5% in the wavelength range between 350 nm and 400 nm of the UV light is sufficient in order to be able to achieve a sufficient exposure of the adhesive located behind it in the exposure direction.

In measurements of the transmittance of the decorative material the following values were determined, for example:

| Color shade of the decorative material | Transmittance in percent at approximately 395 nm | Layer thickness of the decorative material in μm |
|---|---|---|
| Glazing color varnish, cyan | 35% | 6 |
| Glazing color varnish, magenta | 53% | 6 |
| Glazing color varnish, yellow | 15% | 6 |
| Glazing color varnish, black | 3.5% | 6 |
| Covering color varnish, white | 0% | 15 |
| Vapor-deposited aluminum with a thickness of from approx. 15 nm to 20 nm | 6.3% | — |

If, in particular, the transmittance of the decorative material is too low for a sufficient exposure of the adhesive, for example in the case of the opaquely white decorative material mentioned above, it is advantageous that the decorative material is arranged in the form of a grid in first zones with decorative material and second zones without decorative material. It is particularly advantageous here to arrange the first and/or second zones in the form of thin lines and/or small grid elements with a line width and/or with a minimum grid element dimension of less than 500 μm, preferably of less than 250 μm. The UV light can reach through the second zones without decorative material to the adhesive in a sufficient quantity and there expose these sufficiently for the curing. The first zones can be at least partially irradiated from below because of their small size, with the result that the adhesive can also be at least partially exposed, and thus cured, there.

The ratio of the average width of the first zones to the average width of the second zones is preferably between 0.75:1 and 1:5. Thus, the width of the first zones is preferably less than 250 μm and the width of the second zones is more than 250 μm.

The first and second zones are preferably arranged according to a one- or two-dimensional grid, for example a line grid or a surface grid. Thus, it s possible for the first zones and/or second zones to be formed as dots or in the shape of a polygon. The grid element shapes are preferably selected from: dots, diamonds and crosses. However, it is also possible to use differently formed grid element shapes.

The grid or the distribution of the first and second zones is preferably formed regular or random (stochastic) or pseudo-random.

It is further also possible for the one- or two-dimensional grid to be a geometrically transformed grid. Thus, it is possible for example for it to be a circularly or wavily transformed one-dimensional grid, wherein for example the first zones are provided in the form of concentric circular rings or in the form of wavy lines.

Alternatively, the adhesive can also be provided as a physically or chemically curing adhesive, wherein the drying is then preferably effected by a thermal drying. The curing device 5 is then formed correspondingly as a thermal drying device.

To transfer the decorative material from the transfer medium 3 to the object 13, the object 13 to be decorated is placed underneath the pressing device 2 by means of the holding device 1. The transfer medium 3 is then moved over the cylinder 20 with the decorative and adhesive layers pointing in the direction of the object 13 and guided through above the object 13 fixed in the holding device 1, wherein the decorative layer side of the transfer medium 3 faces the surface to be decorated of the object 13. The transfer of the decorative its material is effected by pressing onto the object 13 with a predefined pressing pressure on the transfer medium 3 guided over the object 13 tangentially along the area of contact 14 by means of the cylinder 20. The cylinder 20 and the object 13 are rotated such that the surface area speed of the transfer medium 3 corresponds to the surface speed of the object 13.

The UV adhesive is cured by the. UV light at the same time as the transfer medium 3 is pressed onto the object 13. Through the rotation of the object 13 and the tangential course of the transfer medium 3 relative to the object 13 the transfer medium is detached from the object 13 again immediately after the curing of the adhesive. At the locations at which adhesive was applied to the transfer medium 3 the decorative material (for example decorative inks or a metal layer) adheres to the object 13 by means of the cured adhesive after the curing of the adhesive. At the locations at which there was no adhesive the decorative material remains on the transfer medium.

To compensate for dimensional variations of the object 13 the cylinder 20 can be mounted floating or suspended in the pressing device 22. For example, a pressure-regulated pneumatic cylinder can be used, wherein the pressing force of the cylinder 20 onto the object 13 is variably adjustable by altering the air pressure setting of the pneumatic cylinder. The compensation of dimensional variations relative to the surface of the object 13 is effected with the elastic vertical lifting movement of the cylinder 20 corresponding to the set pressing force. Alternatively, the vertical variable lifting movement and the control of the pressing force can be effected via compression springs with settable spring tension, instead of with compressed air and pneumatic cylinder.

The design of the pressing device 2 with a hollow cylinder 20 for transferring the decorative material is also suitable for transferring to flat objects. In the case of objects with flat surfaces, such as e.g. objects with square or rectangular cross section, as well as flat, rigid objects, the adhesive can likewise be applied both to the object and to the decorative layer of the transfer medium. For the transfer of the decorative material the pressing device 2 is moved horizontally. The decorative material is transferred to the surface of the object by radial unrolling of the cylinder 20 over the object with simultaneous irradiation by the curing device 5.

Figure 2:
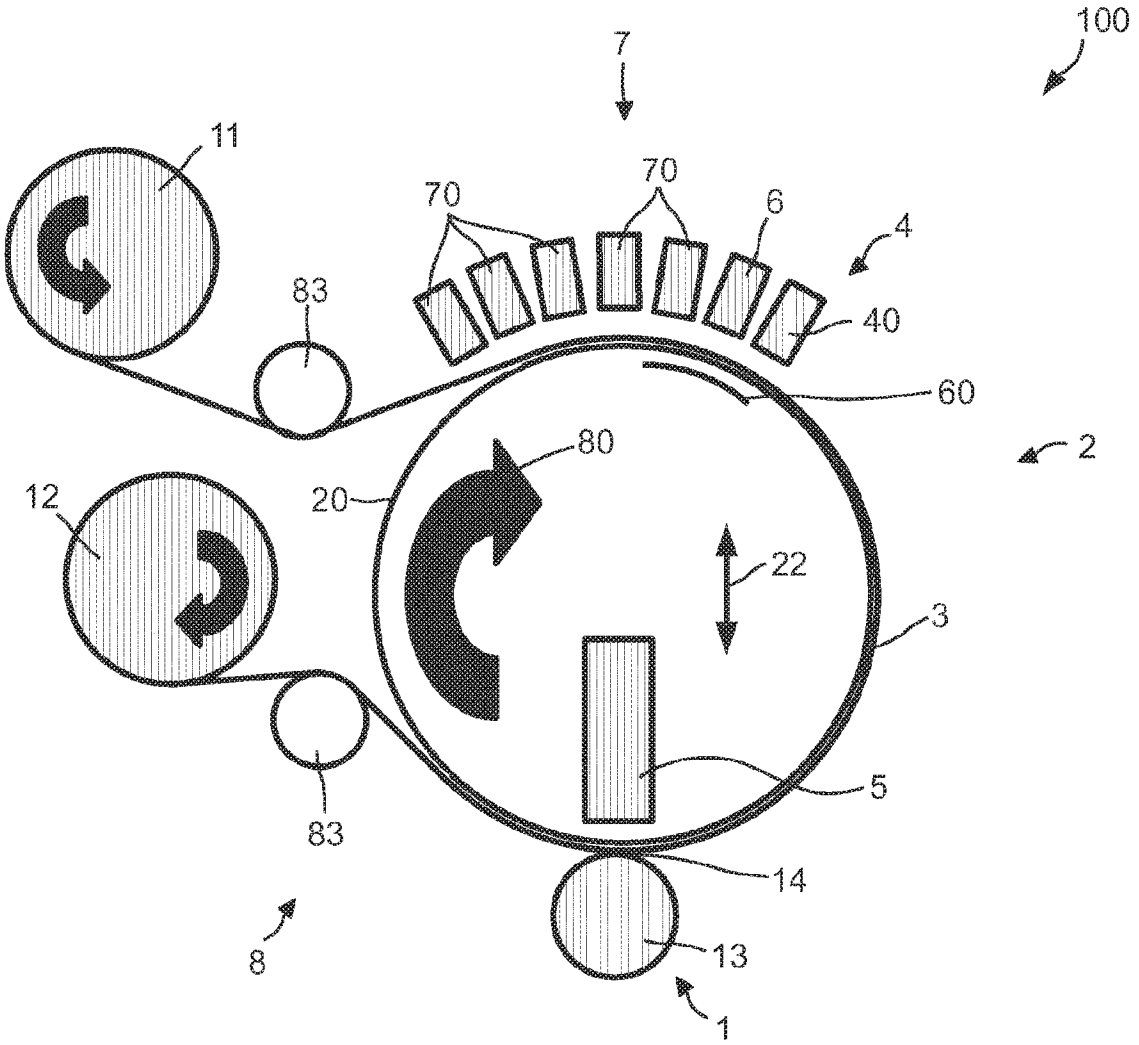
FIG. 2 a schematic representation of a device for the decoration of objects to be decorated.

A representation of a device 100 for the decoration of objects 13 to be decorated is shown schematically in FIG. 2. The device 100, corresponding to that in FIG. 1, in a movement direction 80 of the transfer medium 3, has a transfer media unrolling device 11, a printing device 7, a pressing device 2 and a transfer media rolling-up device 12.

The transfer medium 3, coming from the transfer media unrolling device 11, is directed over a first vacuum roller 83 of the transfer media guide 8 directly to a hollow cylinder 20 of the pressing device 2. The transfer medium 3 surrounds the cylinder 20 at a deflection angle of approximately 300°. Then the transfer medium 3 is fed to the transfer media rolling-up device 12 via a further vacuum roller 83.

Unlike the device 100 from FIG. 1, the printing device 7 according to the second embodiment is arranged directly on the cylinder 20 of the pressing device 2. The cylinder 20 therefore also acts as a printing base for the printing device 7. The printheads 70 of the printing device 7 are accordingly arranged radially at a predefined radial distance from the outer surface of the cylinder 20. The drying unit 6 and the adhesive-applying device 4 are formed as part of the printing device 7 and are likewise arranged downstream of the printheads 70 at a radial distance. In order to prevent UV light emitted by the drying unit 6 from scattering, a light-impermeable cover 60 is arranged inside the cylinder 20 in the area of the drying unit 6.

To print on, dry and apply adhesive to the transfer medium 3, the cylinder 20 is rotated at a predefined rotational speed corresponding to a predefined printing speed or printing capacity. The printing on, drying and applying of adhesive to the transfer medium 3 is furthermore effected corresponding to the procedure which was described in relation to FIG. 1.

Analogously to the first embodiment, a holding device 1, which holds the object 13 to be printed on, is arranged underneath the horizontally arranged cylinder 20. The transfer of the decorative material by the pressing device 2 is effected analogously to the method described in relation to the first embodiment. Therefore, a pressing of the transfer medium 3 by means of the cylinder 20 onto the object 13 and a simultaneous curing of the adhesive by the curing device 5 are effected. The position of the second vacuum roller 83 is sellable, with the result that the angle of detachment of the transfer medium 3 from the object 13 can be adapted in order to achieve an optimum detachment of the decorative material.

Further, it is expedient that the surface of the object 13 is pretreated before the decoration. This pretreatment can comprise in particular an object-cleaning step and/or an activation step.

In the object-cleaning step dirt and/or also existing protective coatings or other functional coatings which were applied in particular for the transport of the object 13 and/or during the production of the object 13 are preferably removed.

In the case of glassy surfaces in particular problems continue to occur because of the moisture bound to the surface. The moisture is bound in particular in the form of gel layers, which negatively affect the adhesive properties of the layers subsequently to be applied to the surface.

The ability of the surface to make an adhesion to layers subsequently to be applied, in particular a decoration, possible also depends on the applied or produced reactive groups on the surface, as these are the basis for the fixed binding of the subsequently applied layers. The density of the reactive OH groups located in the silicate layer of glass is not sufficient in the known methods, which leads to a reduced adhesion of the layers applied afterwards.

In the activation step, which is preferably effected after the object-cleaning step, the surface of the object 13 is advantageously modified in such a way that an adhesion of the subsequently applied decoration is increased and improved. The modification can be effected chemically and/or physically.

The object-cleaning step comprises in particular a modification of the surface of the object 13 with at least one oxidizing flame. The object-cleaning step has the advantage that the moisture bound to the amorphous surface of the compact substrate in the form of inhomogeneous gel layers is reduced. Surprisingly, the gel layer is reproducibly reduced by the object-cleaning step. The gel layer is dependent on the respective amorphous structure as well as on the ageing state of the gel layer. The gel layer and thus the bound moisture are reduced by the oxidizing flame. The reduction of the gel layer leads to reproducible, homogeneous surface properties.

By an oxidizing flame is meant here any ignited gas, gas-air mixture, aerosol or spray which contains an excess of oxygen and/or can have an oxidizing action.

The activation step comprises, in particular modifying the surface of the object 13 with at least one silicating flame. In the process a silicon oxide layer up to 60 nm, preferably 5 nm to 50 nm, further preferably 10 nm to 30 nm, thick which is characterized by a high content of reactive OH groups is applied. The homogeneity and the good adhesive properties of the deposited silicon oxide layer are achieved by the combination of the object-cleaning step and the activation step. It is advantageous to choose the number of flames such that one to ten, in particular one to five, oxidizing and/or silicating flames modify the surface of the object 13.

The reactive groups on the surface are the chemical basis for a fixed chemical bonding of the subsequently applied surface-treated layers, for example wax layers and/or varnish layers and/or ink layers. If the surface consists of an amorphous substance, for example of glass, the area density of the OH groups of the surface of the compact substrate according to the invention is 2 to 5 times higher than in the case of untreated surfaces.

The silicon oxide layer or silicate layer applied in the second treatment step has a submicroscopic roughness. The roughness and the associated mechanical anchoring possibility for further layers lead to a clearly improved adhesion of all subsequent layers. A reproducible, homogeneous, microretentive surface is produced by the object-cleaning step and the activation step. The combination of the two method steps surprisingly leads to a reduction of the gel layer and to an increase in the density and to a homogeneous distribution of the reactive OH groups.

In the activation step, for the flame treatment, a gas is used which contains compounds having components selected from the group alkyl silanes, alkoxy silanes, alkyl titanium, alkoxy titanium, alkyl aluminum, alkoxy aluminum or combinations thereof.

Preferred examples of such compounds are tetramethyl silane, tetramethyl titanium, tetramethyl aluminum, tetraethyl silane, tetraethyl titanium, tetraethyl aluminum, 1,2-dichlorotetramethyl silane, 1,2-dichlorotetramethyl titanium, 1,2-dichlorotetramethyl aluminum, 1,2-diphenyltetramethyl silane, 1,2-diphenyltetramethyl titanium, 1,2-diphenyltetramethyl aluminum, 1,2-dichlorotetraethyl silane, 1,2-dichlorotetraethyl titanium, 1,2-dichlorotetraethyl aluminum, 1,2-diphenyltetraethyl silane, 1,2-diphenyltetraethyl titanium, 1,2-diphenyltetraethyl aluminum, 1,2,3-trichlorotetramethyl silane, 1,2,3-trichlorotetramethyl titanium, 1,2,3-trichlorotetramethyl aluminum, 1,2,3-triphenyltetramethyl silane, 1,2,3-triphenyltetramethyl titanium, 1,2,3-triphenyltetramethyl aluminum, dimethyldiethyl tetrasilane, dimethyldiethyl tetratitanium, dimethyldiethyl tetraaluminum and similar compounds.

In addition, among such alkyl compounds, a silane compound, an alkyl titanium compound and an alkyl aluminum compound, tetramethyl silane, tetramethyl titanium, tetramethyl aluminum, tetraethyl silane, tetraethyl titanium and tetraethyl aluminum are preferred modifying compounds because of their particularly low boiling point and their easy miscibility with air and similar gases, while a silane halide compound such as 1,2-dichlorotetramethyl silane is preferably used as modifier.

In addition, alkoxy silane, alkoxy titanium and alkoxy aluminum compounds are to be preferred among the above-named compounds, as long as their boiling point lies in the range between 10° C. and 100°, as generally, although they usually have high boiling points because of their ester structure, they make an even better surface-modifying action of the solid substrate possible.

By a silicating flame within the meaning of the invention is meant any ignited gas, gas-air mixture, aerosol or spray with the aid of which a silicon oxide layer is applied to a surface by flame pyrolytic decomposition of a silicon-containing substance. It can in particular be provided that the silicon-containing coating is applied substantially carbon free and that in the flame pyrolysis a silicon alkoxy silane is introduced as silicon-containing substance into a mixture of air and combustion gas as well as oxygen as needed. The combustion gas comprises for example propane gas, butane gas, coal gas and/or natural gas.

It is advantageous if the value of the average molecular weight of the modifying compound lies in the range of from 50 to 1000, preferably in the range of from 60 to 500, further preferably in the range of from 70 to 200, measured by mass spectrum analysis. With an average molecular weight of the modifying compound below 50 the volatility is high and the handling is sometimes difficult. If, on the other hand, the value of the average molecular weight of the modifying compound lies above 1000, the vaporization by heating and slight mixing with air or similar gases is difficult in some cases.

Further, it is advantageous if the density of the modifying compound in the liquid state lies in the range of from 0.3 $g/cm^3$ to 0.9 $g/cm^3$, preferably in the range of from 0.4 $g/cm^3$ to 0.8 $g/cm^3$, further preferably in the range of from 0.5 $g/cm^3$ to 0.7 $g/cm^3$. With a density value of the modifying substance in the liquid state below 0.3 $g/cm^3$ the handling is made more difficult and the accommodation in aerosol cans sometimes becomes problematic. If, on the other hand, the density of the modifying compound in the liquid state lies above 0.9 $g/cm^3$, the vaporization is made more difficult and in the case of accommodation in aerosol cans a complete separation can result in some cases with air or similar gases.

It is advantageous if the modifying compound is heated and vaporized, and is mixed with the combustion gas in the vaporized state and then combusted. The boiling point of the modifying compound preferably lies between 10° C. and 80° C.

The quantity of the modifying compound in the combustion gas has in particular a value in the range of from $1\times10^{-10}$ mol-% to 10 mol-% of the total quantity of the combustion gas.

The wetting index after the surface modification has in particular a value in the range of from 40 mN/m (dyn/cm) to 80 mN/m (dyn/cm) at a measurement temperature of 25° C.

The flame temperature of the oxidizing and/or silicating flame preferably lies in the range of from 500° C. to 1500° C., in particular of from 900° C. to 1200° C., and/or the surface of the object is advantageously heated to 35° C. to 150° C., in particular to 50° C. to 100° C.

The duration of treatment with the oxidizing and/or silicating flame lies in particular in the range of from 0.1 seconds to 100 seconds, preferably in the range of from 0.1 seconds to 10 seconds, particularly preferably in the range of from 0.1 seconds to 5 seconds.

In order to be able to easily control the flame temperature of the oxidizing and/or silicating flame, it is recommended to add a combustible gas to the combustion gas. Hydrocarbon gases such as propane gas and natural gas or combustible gases such as hydrogen, oxygen, air and the like can be used as such combustible gases. If combustible gases which are stored in aerosol cans are used, it is to be preferred to use propane gas and compressed air or the like.

It is preferred that the value of the quantity of combustible gas contained lies in the range of from 80 mol-% to 99.9 mol-% of the total quantity of combustion gas, preferably in the range of from 85 mol-% to 99 mol-%, further preferably in the range of from 90 mol-% to 99 mol-%. With a combustion gas content below 80 mol-% the mixing properties of the modifying compound decrease and the air leads in some cases to an incomplete combustion of the modifying compound. If the value of the combustion gas quantity contained, on the other hand, lies above 99.9 mol-%, in some cases the modifying action of surfaces does not apply.

It is preferred to also add a carrier gas for the oxidizing and/or silicating flame, in order to be able to mix the quantity of the modifying compound uniformly into the combustion gas. It is to be preferred to premix the modifying compound with a carrier gas and then to mix it into the combustible gas, such as e.g. the air stream. Through the addition of a carrier gas, even if a modifying compound with a relatively high molecular weight which is to be transported only with difficulty is used, this can be mixed uniformly into the air stream. Through the addition of the carrier gas the modifying compound becomes easily combustible and the modification of the surface of the article can be carried out uniformly and sufficiently.

It is preferred that the same gas type as for the combustible gas, e.g. air and oxygen or hydrocarbon gases such as propane gas and natural gas, is used for the carrier gas.

Through the combined treatment of the surface with at least one oxidizing and at least one silicating flame, a homogeneous, microretentive surface is provided which has a high density of reactive groups.

The roughness and the good adhesive property of the silicate layer applied in the activation step advantageously have the result that a subsequently applied decoration, in particular the subsequently applied decorative material, for example a printing ink or other decorative or functional layers, adheres very well. The decorative material applied to the silicate layer are is advantageously scratch- and abrasion-resistant and has a high resistance to water and water vapor. Due to the homogeneous silicate layer produced, a high ink coverage of the printing inks applied by the decoration is advantageously achieved. The properties of the decorative layers such as hue, color strength, metamerism, coverage and transparency can advantageously be virtually freely chosen through the correspondingly pretreated surface.

The object-cleaning step and/or the activation step can in particular be carried out with the aid of a further pretreatment device for pretreating the object 13. The further pretreatment device for pretreating the object 13 can be designed for the implementation of both steps or a separate object-cleaning device and a separate activation device can be provided separately from each other.

The further pretreatment device for pretreating the object 13 and/or the object-cleaning device and/or the activation device can be designed as a module for installation in the device 100 for the decoration of objects 13, in particuiar for installation in the holding device 1. With the corresponding module, a pretreatment of the surface of the object 13 can then be carried out inside the device 100 before subsequent process steps are carried out.

The pretreatment device and/or the object-cleaning device and/or the activation device can also be designed as a separate device which can correspondingly pretreat the surface of the object 13 independently of further devices.

The object-cleaning device and/or the activation device can, in a preferred embodiment, have a ring-shaped flame treatment device, wherein the object 13 to be pretreated is arranged inside a ring and the oxidizing or silicating flame can emerge from the ring in the direction of the surface of the object 13.

The object-cleaning device and/or the activation device can, in a further embodiment, have a flame treatment device formed rectilinear at least in sections. This flame treatment device is then guided or moved in sections over the surface to be pretreated of the object 13.

The object-cleaning device and/or the activation device can, in a further embodiment, have a flame treatment device with one or more flames emerging at points. This flame treatment device is then guided or moved in sections over the surface to be pretreated of the object 13. During the decoration of three-dimensional objects the object 13 is held in the holding device 1 preferably rotatable about an axis of rotation. This axis of rotation is preferably the longitudinal axis of the objects 13.

Figure 3:
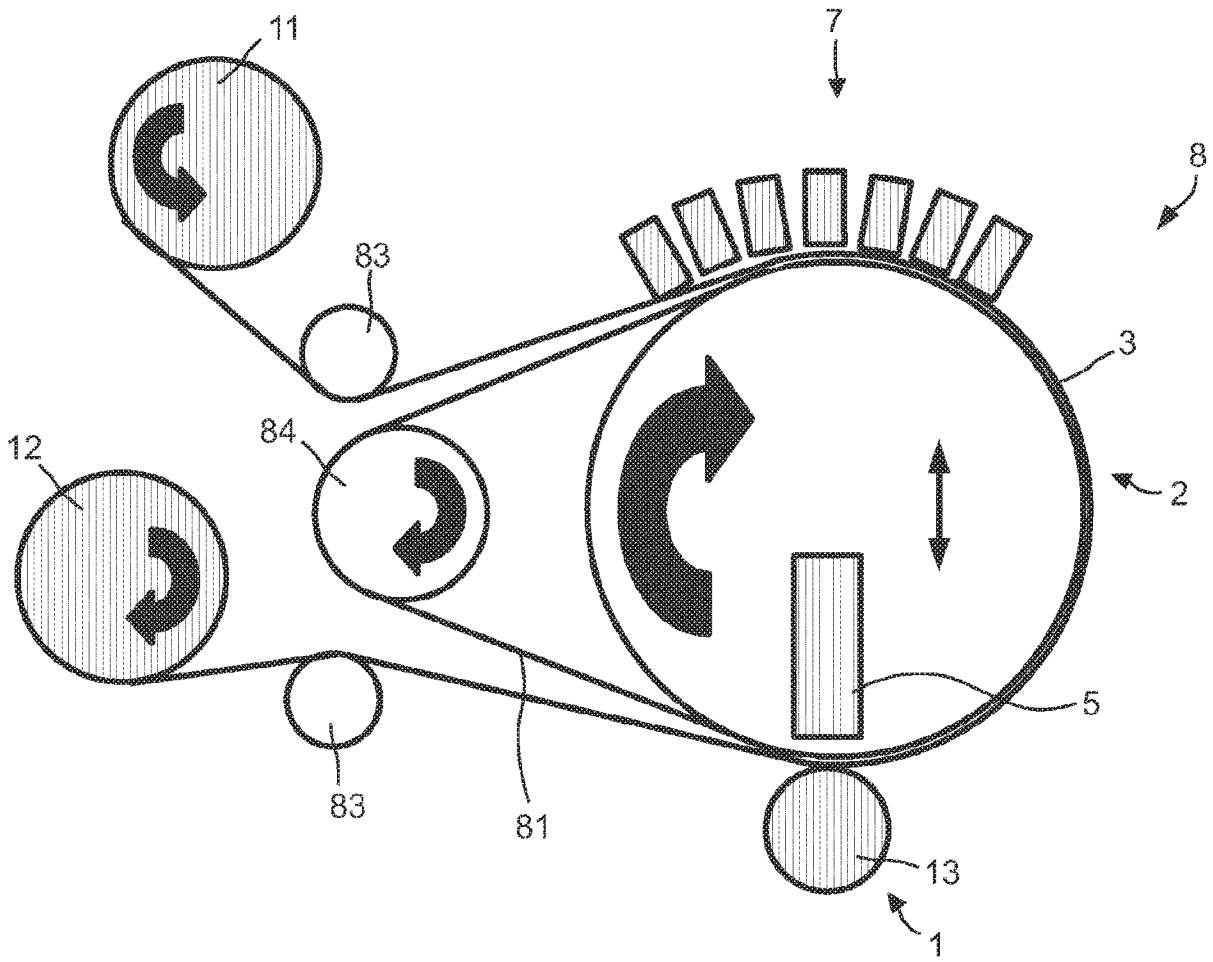
FIG. 3 a schematic representation of a device for the decoration of objects to be decorated.

FIG. 3 shows, schematically, a representation of a device 100 for the decoration of objects 13 to be decorated. The device 100 shown here corresponds substantially to the device 100 according to FIG. 2. However, the pressing device additionally has a dimensionally stable, tension-stable guide belt 81 formed as an endless belt. The guide belt 81 is clamped between a tensioning roller 84 and a driven cylinder 20 and envelops the latter at a deflection angle of approximately 250°. The guide belt 81 is transparent for the radiation emitted by the curing device 5. Furthermore, it has an elastic pressing layer on its outside. During the printing with decorative material and adhesive in the printing device 7 the transfer medium 3 lies on the guide belt 81 at least until it is pressed onto the object 13. Thus, a secure guiding of the transfer medium 3 is made possible.

Figure 4:
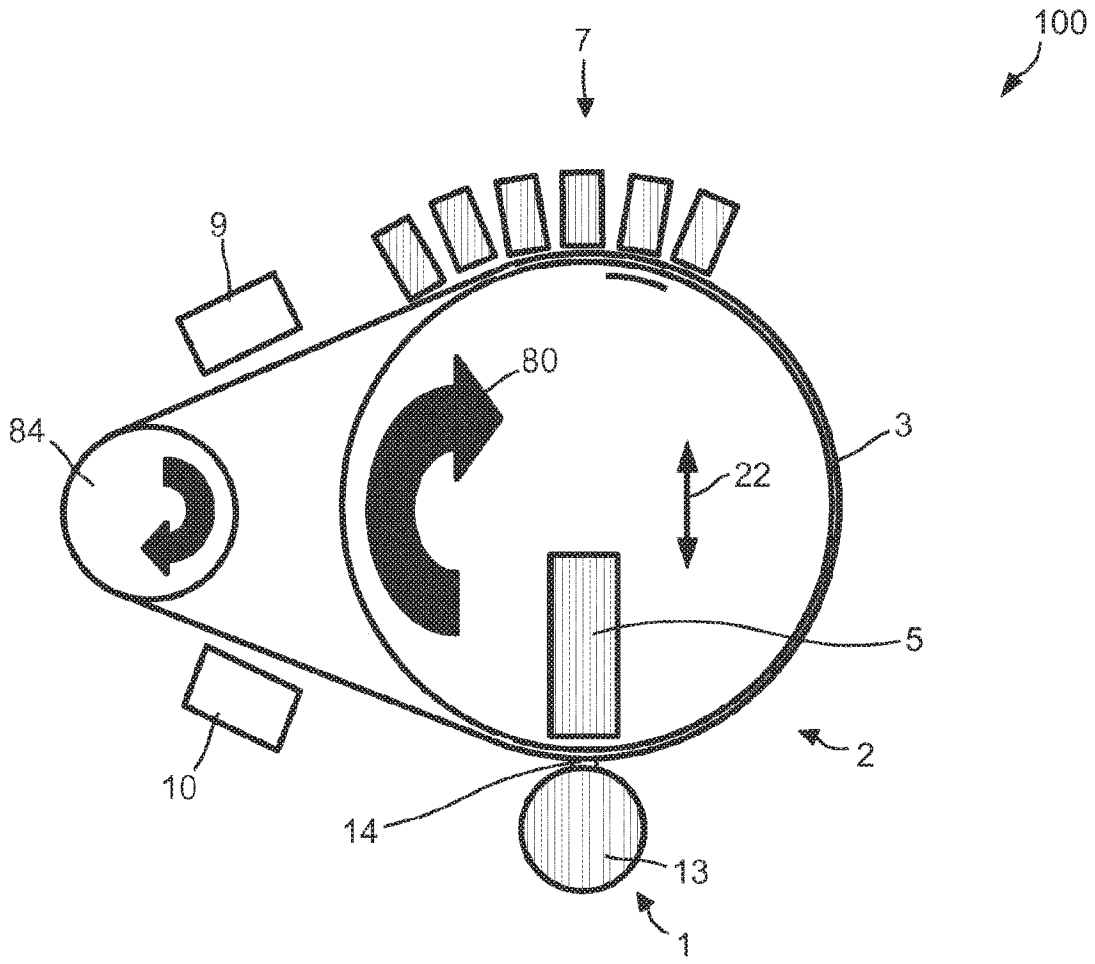
FIG. 4 a schematic representation of a device for the decoration of objects to be decorated.

FIG. 4 reveals a schematic representation of a device 100 for the decoration of an object 13 to be decorated. The device 100 has a pressing device 2 with a transparent, hollow cylinder 20 and a curing device 5 arranged inside the cylinder 20.

Furthermore, the device has a transfer medium 3 provided as an endless belt, which, corresponding to the endless belt from FIG. 3, is dimensionally stable and tension-stable and furthermore is clamped between a tensioning roller 84 and the driven cylinder 20 and envelops the latter at a deflection angle of approximately 250°. The cylinder 20 has a flexible pressing layer on its outside, via which the transfer medium 3 provided as an endless belt is guided.

The printing on the transfer medium 3 and the transfer of the decorative material to the object 13 are effected analogously to the method described in relation to FIG. 3. After the pressing of the transfer medium 3 onto the object 13 held by the holding device 1 and the detachment of the transfer medium 3 from the object 13 after the transfer of the decorative material, the transfer medium 3 is deflected via the tensioning roller and conveyed back to the printing device 7, where it is again provided with decorative material and adhesive in order to provide at least one further object with the newly applied decorative material.

In order that the decoration is not distorted by decorative material remaining on the transfer medium 3 during a renewed printing on the transfer medium 3, a cleaning device 10, in which the transfer medium 3 is cleaned of decorative material and adhesive residues, is arranged between the holding device 1 and the printing device 7. Downstream of the cleaning device 10 and upstream of the printing device 7, a pretreatment device 9 is provided, by means of which any damage to the separating layer of the transfer medium 3 arising due to the cleaning is mended. Furthermore, the pretreatment device 9 can for example also have at least one printhead for printing on the transfer medium 3 with a separating varnish or a detachment layer and/or with an application aid for the decorative material to be applied by the printing device.

Figure 5:
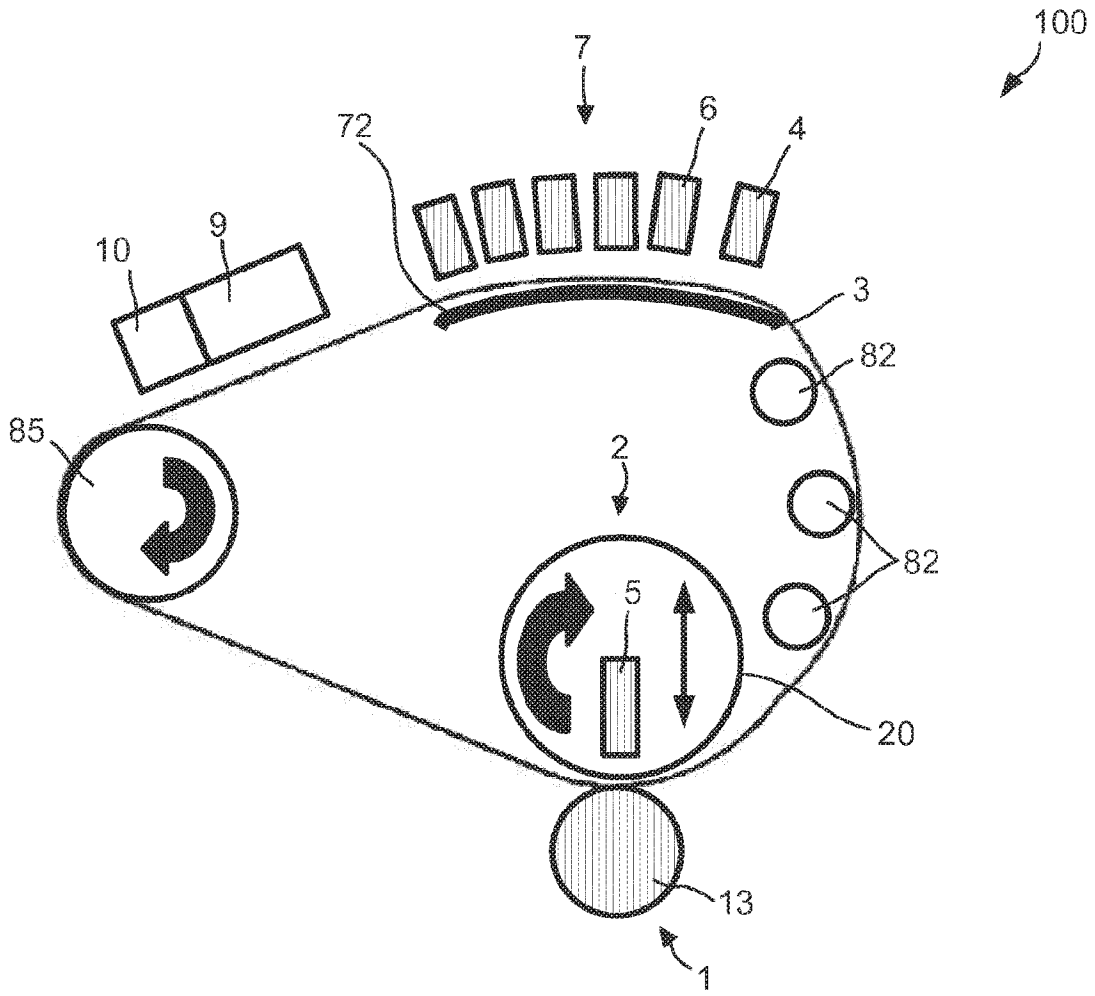
FIG. 5 a schematic representation of a device for the decoration of objects to be decorated.

FIG. 5 shows, schematically, a representation of a device 100 for the decoration of objects 13 to be decorated.

The device 100 has a transfer medium 3 in the form of a dimensionally stable, tension-stable, transparent endless belt. The transfer medium 3 is ground by a drive roller 85. It winds around the horizontally mounted drive roller 85 at an angle of approximately 130°. The drive roller 85 is equipped with a vacuum support in the area of contact with the endless belt transfer medium 3 to ensure a frictionless sequence of movements.

After a cleaning in a cleaning device 10 and a subsequent pretreatment in a pretreatment device 9, the transfer medium 3 is printed on in a printing device 7 and provided with adhesive. The printing device 7 has substantially the structure of the printing device 7 from FIG. 1, wherein the printing base plate 72 here has an irregular curvature and the printheads 70 are arranged corresponding to the curvature over the printing base plate 72. Following that, the transfer medium 3 is conducted further to a pressing device 2 with a transparent cylinder 20 which is provided with a pressing layer flexible on the outer sides via deflection rollers 82 arranged on the unprinted side of the transfer medium 3, which are provided in particular to set the tension of the endless belt transfer medium 3. The pressing device 2 is arranged opposite a holding device 1 for holding the object 13 to be printed on. The transfer of the decorative material and the curing of the adhesive are effected analogously to the method described in relation to the preceding figures. After the transfer of the decorative material, the transfer medium 3 is fed to the cleaning device 10 again via the drive roller 85.

To print decorative material on the transfer medium 3 by means of digital printing, the transfer medium 3 is guided over the curved printing base plate 72 at a movement speed which is predefined corresponding to a printing capacity of the printing device 7.

Alternatively, the printing device 7 can also be formed in such a way that the transfer medium 3 for the printing with decorative material is fixed to the printing base plate 72 and is moved through under the printheads 70, the drying unit 6 and the adhesive-applying device 4 of the printing device 7. For support, vacuum rollers (not shown) can be mounted upstream and downstream of the printing base plate 72.

Furthermore, the device can alternatively also be formed in such a way that a feed of the transfer medium over the printing base plate 72 held in a fixed position is effected by means of vacuum rollers (not shown) which are mounted upstream and downstream of the printing base plate 72.

Figure 6A:
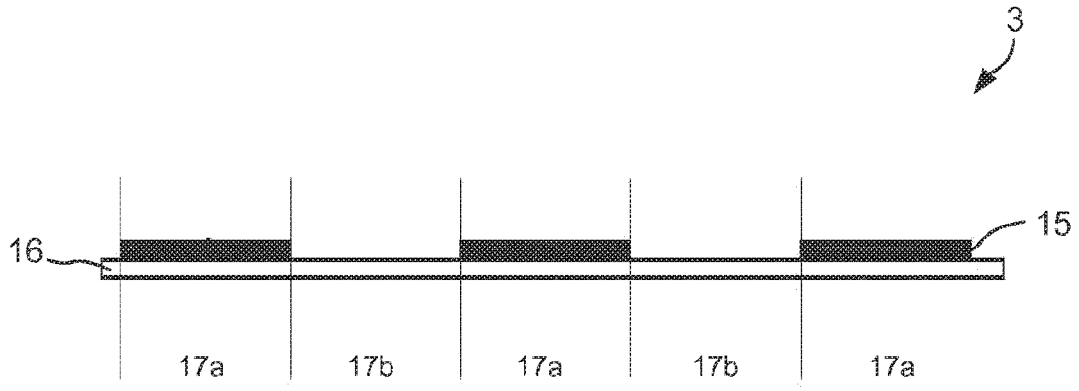
FIGS. 6*a* and 6*b* a schematic representation of a transfer medium.
Figure 6B:
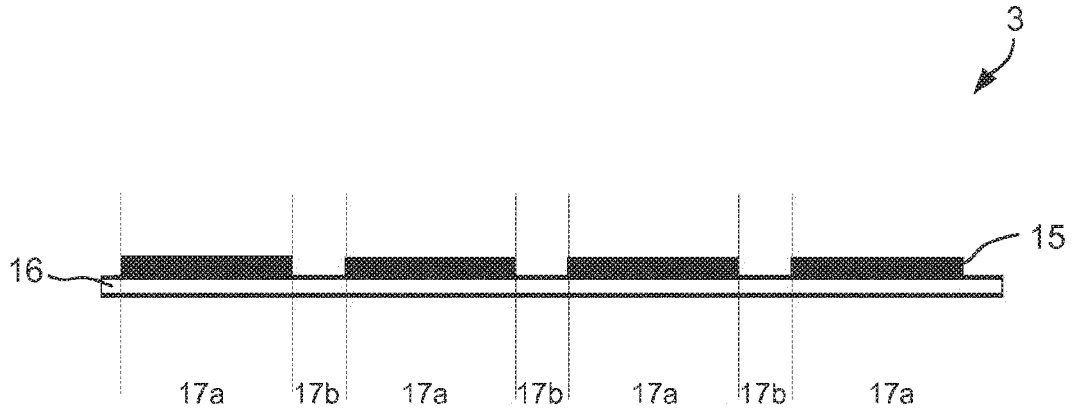

FIGS. 6*a* and 6*b* show, schematically, a representation of a transfer medium 3.

As shown in FIGS. 6*a* and 6*b*, the transfer medium can in particular be a flexible carrier material to which the decorative material 15 is applied detachably again. For example a flexible plastic carrier film 16 made of polyester, polyolefin, polyvinyl, polyimide, acrylonitrile-butadiene-styrene copolymers (ABS), polyethylene terephthalate (PET), polycarbonates (PC), polypropylene (PP), polyethylene (PE), polyvinyl chloride (PVC) or polystyrene (PS) can be used as carrier material. Further, it is possible for a primer layer to be applied to the carrier material in particular the plastic film 16.

The primer layer preferably consists of polyacrylates and/or vinyl acetate copolymers with a layer thickness of from 0.1 μm to 1.5 μm, preferably of from 0.5 μm to 0.8 μm, which forms a surface of the transfer medium 3 facing away from the carrier material. The primer layer can be optimized with respect to the adhesive used in terms of its physical and chemical properties, with the result that an optimum adhesion between object 13 and transfer medium 3 is guaranteed as far as possible irrespective of the object 13. Furthermore, a primer layer optimized in such a way makes, it possible for the deposited adhesive to remain on the transfer medium 3 in the desired resolution largely without running, spreading or squeezing.

In particular, it is expedient if the primer layer is microparous and preferably has a surface roughness in the range of, from 100 nm, to 180 nm, further preferably in the range of from 120 nm to 160 nm. The adhesive can penetrate partially into such a layer and is thereby particularly well fixed in high resolution.

It has proved to be particularly favorable for a primer layer with a pigment count of from 1.5 $cm^3/g$ to 120 $cm^3/g$, preferably with a pigment count of from 10 $cm^3/g$ to 20 $cm^3/g$, to be used.

By way of example, for the calculation, the composition of a primer layer is indicated below (data in grams):

| | |
|---|---|
| 4900 | organic solvent ethyl alcohol |
| 150 | organic solvent toluene |
| 2400 | organic solvent acetone |
| 600 | organic solvent benzine 80/110 |
| 150 | water |
| 120 | binder I: ethyl methacrylate polymer |
| 250 | binder II: vinyl acetate homopolymer |

-continued

| | |
|---|---|
| 500 | binder III: vinyl acetate vinyl laurate copolymer, SC = 50 +/− 1% |
| 400 | binder IV: isobutyl methacrylate |
| 20 | pigment multifunctional silicon oxide, average particle size 3 μm |
| 5 | filler micronized amide wax, particle size 3 μm to 8 μm |

The following is true for the pigment count for this primer layer:

$$PC = \sum_{1}^{x} \frac{(m_P \times f)_x}{(m_B + m_A)} = \frac{20\ \text{g} \times 750}{1020\ \text{g} + 0\ \text{g}} = 14.7\ \text{cm}^3/\text{g}$$

where:

mp=20 g multifunctional silicon oxide f=ON/d=300/0.4 $g/cm^3$=750 $cm^3/g$ for multifunctional silicon oxide $m_B$=120 g binder I+250 g binder II+(0.5×500 g) binder III+400 g binder IV=1020 g $m_A$=0 g.

In this way, starting from a composition of the primer layer found to be good, further possible pigmentations deviating therefrom can be calculated quickly and in an uncomplicated manner.

Furthermore, it is expedient if the primer layer has a surface tension of from 38 mN/m to 46 mN/m, preferably of from 41 mN/m to 43 mN/m. Such surface tensions allow adhesive droplets, in particular of adhesive systems such as described above, with defined geometry to adhere to the surface without running.

If a thermoplastic toner is used it has proved to be particularly favorable for a primer layer with a pigment count of from 0.5 $cm^3/g$ to 120 $cm^3/g$ preferably with a pigment count of from 1 $cm^3/g$ to 10 $cm^3/g$, to be used.

By way of example, for the calculation, the composition of a primer layer for his use is indicated below (data in grams):

| | |
|---|---|
| 340 | organic solvent ethyl alcohol |
| 3700 | organic solvent toluene |
| 1500 | organic solvent acetone |
| 225 | binder I: chlorinated polypropylene |
| 125 | binder II: poly-n-butyl-methyl methacrylate |
| 35 | binder III: n-butyl-methyl-methyl-methacrylate copolymer |
| 148 | pigment multifunctional silicon oxide, average particle size 12 nm |

The following is true for the pigment count for this primer layer:

$$PC = \sum_{1}^{z} \frac{(m_P \times f)_x}{(m_B + m_A)} = \frac{148\ \text{g} \times 4.4}{385\ \text{g} + 0\ \text{g}} = 1.69\ \text{cm}^3/\text{g}$$

where:

mp=148 g multifunctional silicon oxide f=ON/d=220/50 $g/cm^3$=4.4 $cm^3/g$ for multifunctional silicon oxide $m_B$=225 g binder I+125 g binder II+35 g binder III=385 g $m_A$=0 g.

The decorative material 15 is preferably applied directly to the transfer medium 3. However, it is also possible for the decorative material 15 to be applied to an already existing coating of the transfer medium 3. It is likewise possible for the transfer medium 3 to be provided with an existing coating only over areas of the surface and for the decorative material 15 to be applied in free areas between the existing coating and/or to the existing coating. The existing coating can be for example a detachment layer or another functional layer. The existing coating cart alternatively or additionally also be for example an already existing decorative coating made of printed and/or vapor-deposited ink layers, metal layers, reflective layers, protective layers, functional layers or the like.

The detachment layer preferably consists of an acrylate copolymer, in particular of an aqueous polyurethane copolymer, and is preferably free of wax and/or free of silicone. The detachment layer preferably has a layer thickness of from 0.01 μm to 2 μm, preferably of from 0.1 μm to 0.5 μm, and is advantageously arranged on a surface of the plastic carrier film 16. The detachment layer makes a simple and damage-free detachment of the plastic carrier film 16 from the transfer medium 3 possible after the application thereof to the object 13.

The decorative material 15 preferably has one or more varnish layers made of nitrocellulose, polyacrylate and polyurethane copolymer with a layer thickness in each case of from 0.1 μm to 5 μm, preferably of from 1 μm to 2 μm, which is arranged in particular on a surface of the detachment layer facing away from the plastic carrier film 16. The one or more varnish layers can in each case be transparent, translucent or opaque. Thus, it is possible for the one or more varnish layers to be transparently dyed, translucently dyed or opaquely dyed.

The dyeing of the one or more varnish layers can be based on the process colors cyan, yellow, magenta and black, but also on spot colors (e.g. in the RAL or HKS or Pantone® color system). The one or more varnish layers can alternatively or additionally contain metal pigments and/or in particular optically variable effect pigments.

The one or more varnish layers can be present over the whole surface or also only partially, for example as so-called spot varnishing. Optical effects in areas of the surface are made possible by spot varnishing. Here, areas are varnished in a targeted manner for example with a gloss varnish and/or with a matte varnish, in order to optically alter the respective area of surface, in particular to enhance it. As an alternative or in addition to the optical effect, haptic effects can thereby also be achieved. The decorative material 16 preferably has a metal layer made of aluminum and/or chromium and/or silver and/or gold and/or copper, in particular with a layer thickness of from 10 nm to 200 nm, preferably of from 10 nm to 50 nm.

As an alternative or in addition to the metal layer, a layer made of an HRI material (HRI=High Refractive Index) can also be provided. HRI materials are for example metal oxides such as ZnS, $TiO_x$ or also varnishes with corresponding nanoparticles.

In the device 100 or the method for the decoration of objects 13 it is now possible for transfer medium 3 to be transported either continuously or pulsed, wherein the pressing of the transfer medium 3 provided with the decorative material 16 onto the object 13, i.e. in particular the object decoration, and/or the object transport is expediently effected in a pulsed manner. FIGS. 6*a* and 6*b* here now illustrate different effects of a continuous or pulsed transport of the transfer medium 3.

As shown in FIGS. 6*a* and 6*b*, the decorative material 15 is applied to the plastic carrier film 16 in the areas 17*a* and not applied to the carrier film 16 in the areas 17*b*, wherein in particular the location of the areas 17*b* depends on the type of transport of the transfer medium 3. The area 17*b* in which no decorative material 15 is applied to the transfer medium 3 and therefore lies between the areas 17*a* with the applied decorative material 15 is also called repeating pattern 17*b*. The repeating pattern 17*b* is advantageously as small as possible, for example in order to keep the consumption of transfer material low.

FIG. 6*a* illustrates the possibility that the transfer medium 3 is transported continuously. Here, in particular a continuous web speed of the transfer medium 3 is an optimum prerequisite for the continuous printing on the transfer medium 3 by the printing device 7, for example by means of digital printing technology, in high quality.

Thus it is possible for the, in particular pulsed, application of the decorative material 16 to the transfer medium 3 to be effected in the printing device 7 at the same time during the, in particular pulsed, pressing of the transfer medium 3 provided with decorative material 16 onto the object 13 in the pressing device 2.

Preferably, the repeating pattern 17*b* between the individual printing sections 17*a* is determined depending on the pulse and/or print speeds. Thus it is possible for the repeating pattern 17*b* between the individual printing sections 17*a* to become larger or smaller depending on the pulse and/or print speed. In particular, the repeating pattern 17*b* is determined or calculated from the known pulse speed of the object transport and the object decoration. Preferably, in particular in the case of a continuous transport of the transfer medium 3, the pulsed printing on the transfer medium 3 is effected at the same time during the pulsed object decoration. Advantageously, the repeating pattern 17*b* is roughly half as "long" (length in relation to the transport speed of the transfer medium) as the object pulse (object decoration and object transport). The repeating pattern 17*b* is preferably usually set to be constant over the entire course, and is not regulated.

A disadvantage of such a continuous process is that in particular the consumption of he transfer medium 3 is very high, whereby the costs increase.

FIG. 6*b* shows the further possibility, in which the transfer medium 3 is driven in the, in particular in the same, pulse of the transport device of the object 13. In this case, the transfer medium 3 is not continuously driven, but the transfer medium 3 is driven or paused depending on the process step.

Thus, it is possible for the trans medium 3 to be driven depending on the, in particular pulsed, pressing of the transfer medium 3 provided with decorative material 15 onto the object 13 in the pressing device 2. Here, the driving of the transfer medium 3 is preferably effected in the pulse of the transport device of the object 13. Thus, it is possible for the application of the decorative material 15 to the transfer medium 3 and the pressing of the transfer medium 3 provided with decorative material 15 onto the object 13 to be effected in a pulsed manner, wherein the transfer medium 3 is driven or paused depending on the pulsed pressing of the transfer medium 3.

Here, it is advantageous that the repeating pattern 17*b* between the decorative material 15, in particular the printed images, and thus the consumption of the transfer medium 3 is reduced. The printing is preferably effected in the same pulse as that of the object 13. During the printing process, however, the acceleration and the braking of the transfer medium 3 is in particular also effected, with the result that the printing process very often takes place at varying speeds.

A disadvantage of such a pulsed process is that the quality of the applied decorative material 15, such as for example the print quality of the digital printing, is negatively affected in particular by the constantly changing web speed.

A further advantageous possibility is to combine the continuous process and the pulsed process. Preferably, on the one hand, a continuous web speed of the transfer medium 3 during the application of the decorative material 15 to the transfer medium, for example the digital printing process and, on the other hand, a pulsed web speed of the object 13 during the pressing of the transfer medium 3 provided with decorative material 15 onto the object 13, i.e. thus during the object decoration, are sought. Thus, it is possible for the pressing of the transfer medium 3 provided with decorative material 15 onto the object 13 to be effected in a pulsed manner, wherein the application of the decorative material 15 to the transfer medium 3 is effected at a continuous web speed. Thus, in other words, it is possible that while the pressing of the transfer medium provided with decorative material 15 onto the object 13 in the pressing device 2 is effected in a pulsed manner, at the same time transfer medium 3 is transported continuously in the printing device 7, wherein the decorative material is applied to the transfer medium in particular during the continuous transport of the transfer medium 3.

Figure 7A:
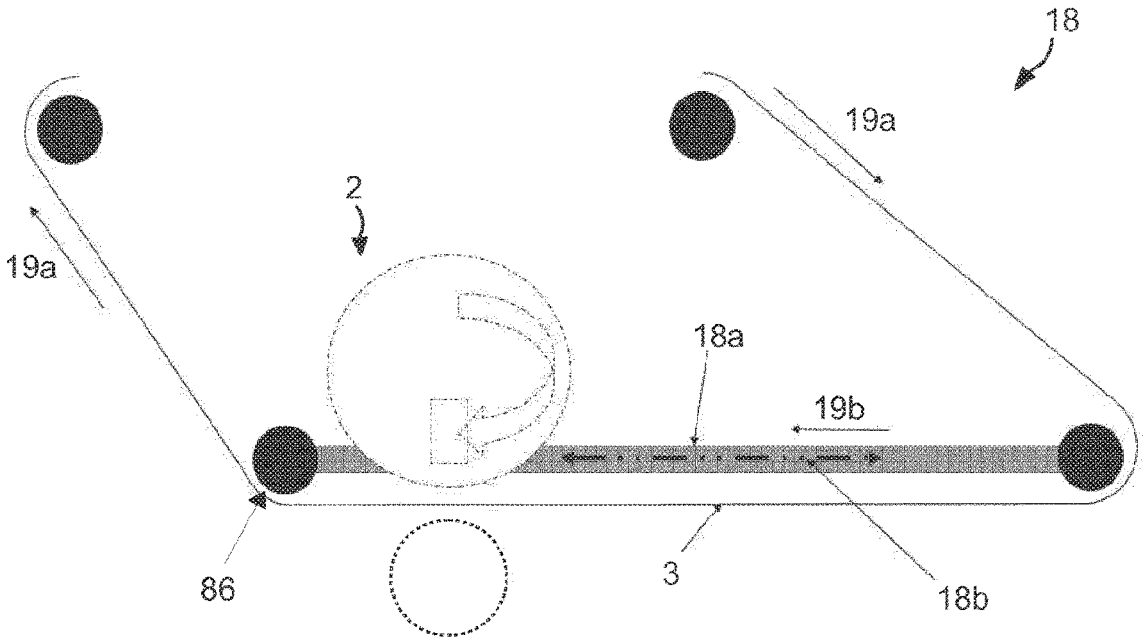
FIGS. 7*a* and 7*b* a schematic representation of a compensation module.
Figure 7B:
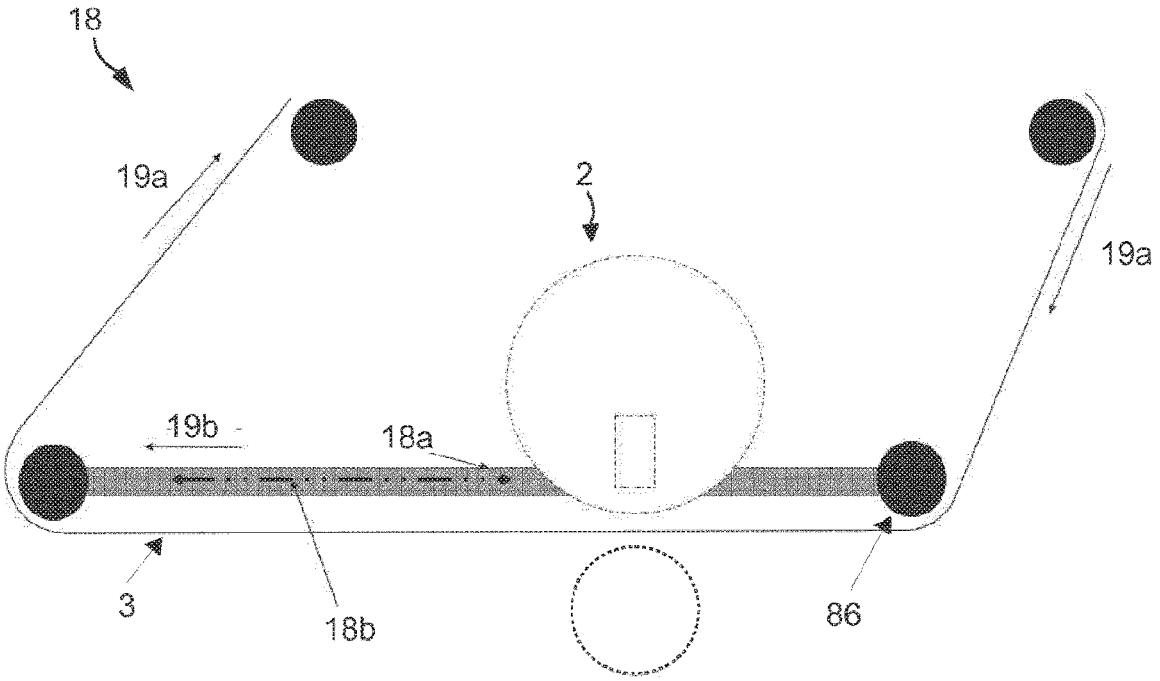

In order to be able to combine the two variants, the device 100 preferably comprises a compensation module 18 or a "store", in particular in order to be able to "collect" or store the transfer medium 3 in the store during an idle phase in the pulsed process for the object 13, with the result that the continuous web speed of the transfer medium 3 advantageous for the quality of the printing is not impaired. Such a compensation module 18 is represented schematically in FIGS. 7*a* and 7*b*. For example, FIG. 7*a* shows the state of the compensation module 18 at the start of the process and FIG. 7*b* shows the state of the compensation module 18 at the end of the process.

The compensation module 18 is in particular formed as a mechanical store 18*a*, which provides the required transfer medium 3 at the required process speed depending on the process section. Such a compensation module 18 can be for example a receiving space for a loop of the transfer medium 3, in particular with means for maintaining the web tension of the transfer medium 3. As shown in FIGS. 7*a* and 7*b*, a loop of the transfer medium 3 is produced by the compensation module 18, wherein the pressing device 2 for pressing the transfer medium 3 provided with decorative material onto the object 13 is advantageously arranged inside the loop. The pressing device 2 and the object 13 are represented shaded, for an overview. With respect to the design of the pressing device 2, reference is made here to the above statements. Further, the compensation module 18 shown in FIGS. 7*a* and 7*b* comprises means for maintaining the web tension of the transfer medium 3 in the form of the deflection or tensioning rollers 86.

Preferably, the compensation module 18 or a mechanical store 18*a* inside the compensation module 18, as shown in FIGS. 17*a* and 17*b*, can store the transfer medium 3 by a lateral movement and release the transfer medium 3 again by changing the movement direction. Thus, it is possible for the compensation module 18 or a mechanical store 18*a* inside the compensation module 18 to receive or store the transfer medium 3 by a lateral movement in a first direction and to release it again by changing the lateral movement into a second direction. Here, the maximum distance of the lateral movement of the compensation module or of the mechanical store 18*a* inside the compensation module 18 is preferably greater, in particular greater by a factor of 2 on average, than the distance which is covered by the transfer medium 3 at a continuous web speed in a predetermined time. The predetermined time here preferably corresponds to the idle phase in which the object 13 is decorated, in particular by pressing of the decorative material. In other words, the pulsed extraction speed for the transfer medium 3 during the extraction is preferably higher than, for example 1.5 times as high as, the continuous speed of filling with the is transfer medium 3, in order that the store 18*a* does not overflow. Through such a compensation module 18, a continuous web speed 19*a*, in particular in the area of the printing device 7, and a pulsed web speed 19*b*, in particular in the area of the pressing device 2, are now preferably achieved inside the device 100.

Where applicable, all individual features which are represented in the embodiment examples can be combined and/or exchanged with each other, without departing from the scope of the invention.

LIST OF REFERENCE NUMBERS

100 device
1 holding device
2 pressing device
20 cylinder
22 pressing device
3 transfer medium
4 adhesive-applying device
40 adhesive printhead
5 curing device
6 drying unit
60 cover
7 printing device
70 printhead
71 printhead movement direction
72 printing base plate
73 plate movement direction
8 transfer media guide
80 movement direction
81 guide belt
82, 86 deflection roller
83 vacuum roller
84, 86 tensioning roller
85 drive roller
9 pretreatment device
10 cleaning device
11 transfer media unrolling device
12 transfer media rolling-up device
13 object
14 area of contact
15 decorative material
16 plastic carrier film
17*a* area
17*b* repeating pattern
18 compensation module
18*a* mechanical store
18*b* movement direction
19*a* continuous web speed
19*b* pulsed web speed

The invention claimed is:

1. A device for the decoration of objects to be decorated, having a holding device for holding an object and a pressing device for pressing a transfer medium provided with decorative material onto the object, the transfer medium comprising a flexible carrier material or a flexible plastic carrier film with the decorative material detachably applied thereon, wherein the device for the decoration of objects to be decorated further comprises a transfer media guide, by means of which the transfer medium is guided through the device and by which the movement of the transfer medium is predefined, wherein a printing device for applying the decorative material to the transfer medium is provided in front of the pressing device, wherein the printing device is arranged upstream of the pressing device viewed in a movement direction of the pressing device or a movement direction of the transfer medium.

2. The device according to claim 1, further comprising an adhesive-applying device for applying adhesive to the transfer medium provided with decorative material or the object and a curing device for curing the adhesive, wherein the pressing device is set up such that the pressing of the transfer medium and the curing of the adhesive can be effected at the same time.

3. The device according to claim 2, wherein the adhesive-applying device is arranged between the printing device and the pressing device, wherein the adhesive-applying device applies the adhesive to the transfer medium printed on by the printing device.

4. The device according to claim 1, wherein the printing device has a UV light source for precuring the decorative material and/or the adhesive-applying device has a UV light source for precuring the adhesive and/or the curing device has a UV light source for curing the adhesive.

5. The device according to claim 4, wherein the distance from the UV light source for curing the adhesive to the object is 2 mm to 50 mm, and/or wherein the gross UV irradiance of the UV light source for curing the adhesive is between 1 $W/cm^2$ and 50 $W/cm^2$, and/or wherein the net UV irradiance of the UV light source for curing the adhesive is between 4.8 $W/cm^2$ and 8 $W/cm^2$.

6. The device according to claim 1, wherein the printing device is designed in such a way that the decorative material is applied to the transfer medium in first zones and is not applied in second zones wherein the first zones and the second zones are arranged according to a one- or two-dimensional grid and/or the ratio of the average width of the first zones to the average width of the second zones is between 0.75:1 and 1:5.

7. The device according to claim 1, wherein a drying unit is provided for drying the decorative material applied to the transfer medium.

8. The device according to claim 1, further comprising a transfer media guide, which is set up to guide the transfer medium tangentially relative to the outer circumference of the object, wherein the pressing device is arranged such that it presses the transfer medium onto the object along an area of contact between object and transfer medium.

9. The device according to claim 8, wherein surface area speed of the transfer medium can be matched to the surface speed of the object in such a way that the surface area speed of the transfer medium and the surface speed of the object differ by less than ±15%.

10. The device according to claim 1, wherein the pressing device furthermore has a flexible pressing layer.

11. The device according to claim 1, wherein the transfer medium is provided as an endless belt.

12. The device according to claim 1, wherein the transfer medium is arranged directly on the pressing device.

13. The device according to claim 1, further comprising a pretreatment device for pretreating the transfer medium before the application of the decorative material and/or a cleaning device for cleaning the printed transfer medium after the pressing of the transfer medium onto the object.

14. The device according to claim 1, wherein the pressing device, is mounted floating or suspended.

15. The device according to claim 1, wherein the pressing device is transparent or translucent, in the wavelength range between 220 nm and 400 nm, wherein the transparency is between 30% and 100%.

16. The device according to claim 1, wherein the device is designed in such a way that the application of the decorative material to the transfer medium is effected in a pulsed manner in the printing device at the same time during the pressing of the transfer medium provided with decorative material onto the object in a pulsed manner in the pressing device.

17. The device according to claim 1, wherein the device is designed in such a way that the transfer medium is driven depending on a pulsed pressing of the transfer medium provided with decorative material onto the object in the pressing device.

18. The device according to claim 1, wherein the pressing of the transfer medium provided with decorative material onto the object is effected in a pulsed manner, and wherein the application of the decorative material to the transfer medium is effected at a continuous web speed.

19. The device according to claim 1, wherein the device comprises a compensation module, which is designed in such a way that the application of the decorative material to the transfer medium and/or the transport of the transfer medium is effected, continuously, at the same time during an idle phase of a pulsed pressing of the transfer medium provided with decorative material onto the object.

20. The device according to claim 19, wherein the compensation module comprises at least one receiving space for a loop of the transfer medium and/or means for maintaining the web tension.

21. The device according to claim 19, wherein the compensation module is designed in such a way that the compensation module or a mechanical store inside the compensation module receives or stores the transfer medium by a lateral movement in a first direction and releases it again by changing the lateral movement into a second direction.

22. The device according to claim 1, wherein the device further comprises a pretreatment device for pretreating the object wherein the pretreatment device comprises an object-cleaning device and an activation device.

23. The device according to claim 22, wherein the object-cleaning device is designed in such a way that dirt and/or also other existing protective coatings or other functional coatings are removed and/or that a modification of the surface of the object is effected with at least one oxidizing flame.

24. A method for the decoration of objects to be decorated, wherein an object is held by a holding device, wherein in a first step decorative material is applied to a transfer medium by a printing device, the transfer medium comprising a flexible carrier material or a flexible plastic carrier film with the decorative material detachably applied thereon, in a second step, adhesive is applied to the transfer medium provided with the decorative material or to the object, and wherein in a third step the transfer medium is pressed onto the object by a pressing device and at the same time the adhesive is cured, wherein, by means of a transfer media guide, the transfer medium is guided through the device and the movement of the transfer medium is predefined, and wherein the transfer medium is not rolled up after being printed on with the decorative material, and is directly guided further to the pressing device without previously coming into contact with a back of rolled-up transfer medium.

25. The method according to claim 24, wherein, in the first step, the decorative material applied to the transfer medium is further precured by a UV light source for precuring the decorative material and/or wherein, in the second step, the adhesive is precured by a UV light source for precuring the adhesive and/or wherein, in the third step, the adhesive is cured by a UV light source for curing the adhesive.

26. The method according to claim 25, wherein, in the third step, the gross UV irradiance of the UV light source for curing the adhesive is between 1 $W/cm^2$ and 50 $W/cm^2$, and/or wherein the net UV irradiance of the UV light source for curing the adhesive is between 4.8 $W/cm^2$ and 8 $W/cm^2$.

27. The method according to claim 24, wherein, in the first step, the decorative material is applied to the transfer medium by the printing device in such a way that the decorative material is applied to the transfer medium in first zones and not applied in second zones wherein the first zones and the second zones are arranged according to a one- or two-dimensional grid and/or the ratio of the average width of the first zones to the average width of the second zones is between 0.75:1 and 1:5.

28. The method according to claim 24, wherein the pressing of the transfer medium onto the object is effected in that the object is rotated about an axis of rotation, and wherein the transfer medium is guided tangentially relative to the outer circumference of the object and wherein pressing device presses the transfer medium onto the object along the area of contact between object and transfer medium.

29. The method according to claim 24, wherein the pressing of the transfer medium onto the object is effected in that the object is held in a fixed position and the transfer medium is unrolled over the surface of the object by means of the pressing device, wherein the pressing device presses the transfer medium onto the object along the area of contact between object and transfer medium.

30. The method according to claim 24, wherein the transfer medium is provided as an endless belt, wherein the sequence of steps is carried out multiple times, wherein in each case a further object is provided with decorative material each time the sequence of steps is carried out.

31. The method according to claim 24, wherein the transfer medium is pretreated before the application of the decorative material.

32. The method according to claim 24, wherein the transfer medium is cleaned after the pressing.

33. The method according to claim 24, wherein the transfer medium provided as an endless belt is cleaned after passing through the pressing device and is then pretreated before the transfer medium is fed back to the printing device for renewed application of decorative material.

34. The method according to claim 24, wherein the application of the decorative material to the transfer medium is effected in a pulsed manner in the printing device at the same time during the pressing of the transfer medium provided with decorative material onto the object in a pulsed manner in the pressing device.

35. The method according to claim 24, wherein the transfer medium is driven depending on a pulsed pressing of the transfer medium provided with decorative material onto the object in the pressing device and wherein the driving of the transfer medium is effected in the pulse of a transport device of the object.

36. The method according to claim 24, wherein the pressing of the transfer medium provided with decorative material onto the object is effected in a pulsed manner, and wherein the application of the decorative material to the transfer medium is effected at a continuous web speed.

37. The method according to claim 24, wherein, through the use of a compensation module, the application of the decorative material to the transfer medium and/or the transport of the transfer medium is effected, continuously, at the same time during an idle phase of a pulsed pressing of the transfer medium provided with decorative material onto the object.

38. The method according to claim 37, wherein the compensation module or a mechanical store inside the compensation module receives or stores the transfer medium by a lateral movement in a first direction and releases it again by changing the lateral movement into a second direction.

39. The method according to claim 24, wherein the object is pretreated before the application of the decorative material, wherein the pretreatment comprises an object-cleaning step and/or an activation step.

40. The method according to claim 39, wherein, in the object-cleaning step, dirt and/or also other existing protective coatings or other functional coatings are removed and/or a modification of the surface of the object is effected with at least one oxidizing flame.

41. The method according to claim 24, wherein, in the first step, a primer layer is further applied to the transfer medium by the printing device wherein the primer layer consists of polyacrylates and/or vinyl acetate copolymers and/or is applied with a layer thickness between 0.1 μm and 1.5 μm.

42. The method according to claim 41, wherein the primer layer is applied in such a way that the primer layer forms a surface of the transfer medium facing away from the carrier material.

43. The device according to claim 1, wherein the transfer media guide is adapted to guide the transfer medium directly from the printing device to the pressing device.

44. The method according to claim 24, wherein the transfer medium is guided directly from the printing device to the pressing device by the transfer medium guide.

* * * * *